US012359897B2

(12) United States Patent
Scotto d'Antuono et al.

(10) Patent No.: US 12,359,897 B2
(45) **Date of Patent: *Jul. 15, 2025**

(54) PYROTECHNIC LAUNCH UNITS AND SYSTEMS

(71) Applicant: Strictly FX, LLC, Nashville, TN (US)

(72) Inventors: Ciro Scotto d'Antuono, Levittown, PA (US); Justin D. Seedle, Hermitage, TN (US)

(73) Assignee: Strictly FX, LLC, Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/761,043

(22) Filed: Jul. 1, 2024

(65) Prior Publication Data

US 2024/0353208 A1 Oct. 24, 2024

Related U.S. Application Data

(63) Continuation of application No. 18/192,898, filed on Mar. 30, 2023, now Pat. No. 12,044,515, which is a (Continued)

(51) Int. Cl.
*F42B 4/24* (2006.01)
*F41B 11/52* (2013.01)

(Continued)

(52) U.S. Cl.
CPC ..... *F42B 4/24* (2013.01); *F41B 11/52* (2013.01); *F41B 11/80* (2013.01); *F42B 4/18* (2013.01);

(Continued)

(58) Field of Classification Search
CPC ..... F42B 4/00; F42B 4/18; F42B 4/20; F42B 4/22; F42B 4/24; F41B 11/52; F41B 11/722; F41B 11/80; F41F 1/00
See application file for complete search history.

(56) References Cited

U.S. PATENT DOCUMENTS 2,103,936 A * 12/1937 Decker ..... F42B 4/24 102/357
3,572,248 A 3/1971 Dardick (Continued)

FOREIGN PATENT DOCUMENTS

CA 2018331 C 5/1995
CA 2564823 A1 11/2005

(Continued)

OTHER PUBLICATIONS

International Search Report for corresponding International Application No. PCT/US2021/021707, dated May 27, 2021.

(Continued)

*Primary Examiner* — Gabriel J. Klein
(74) *Attorney, Agent, or Firm* — Michael Best & Friedrich LLP

(57) ABSTRACT

A modular pyrotechnic launch unit includes a launch module, a first module, and a second module. The launch module includes a launch barrel. The first module is coupled in series to the launch module. The first module includes a first ignition state in which the first module ignites a pyrotechnic element that will then pass through the launch barrel. The first module also includes a first pass-through state in which the first module allows a pyrotechnic element ignited by another module to pass through the first module. The second module is coupled in series to the first module. The second module includes a second ignition state in which the second module ignites a pyrotechnic element that will then pass through the first module and through the launch barrel.

19 Claims, 28 Drawing Sheets

Related U.S. Application Data continuation of application No. 17/802,366, filed as application No. PCT/US2021/021707 on Mar. 10, 2021, now Pat. No. 11,898,832.

(60) Provisional application No. 62/987,991, filed on Mar. 11, 2020.

(51) Int. Cl.

| | |
|---|---|
| ***F41B 11/80*** | (2013.01) |
| ***F42B 4/18*** | (2006.01) |
| ***F42B 4/20*** | (2006.01) |
| ***F42B 4/22*** | (2006.01) |
| ***F42B 4/26*** | (2006.01) |

(52) U.S. Cl.

CPC ..... *F42B 4/20* (2013.01); *F42B 4/22* (2013.01); *F42B 4/26* (2013.01)

(56) References Cited

U.S. PATENT DOCUMENTS

| | | | | |
|---|---|---|---|---|
| 3,601,061 | A * | 8/1971 | Dardick | F42B 5/045 102/434 |
| 3,952,658 | A * | 4/1976 | Broyles | F42B 12/58 102/438 |
| 4,862,802 | A | 9/1989 | Streifer et al. | |
| 4,892,037 | A | 1/1990 | Betts | |
| 5,282,455 | A | 2/1994 | Adamson et al. | |
| 5,339,741 | A | 8/1994 | Craven et al. | |
| 5,415,152 | A | 5/1995 | Adamson et al. | |
| 5,739,462 | A | 4/1998 | Poor et al. | |
| 6,318,350 | B1 * | 11/2001 | Williams | A01M 31/00 124/75 |
| 6,393,990 | B1 | 5/2002 | Fagan | |
| 8,157,169 | B2 | 4/2012 | Olden et al. | |
| 10,166,560 | B2 * | 1/2019 | Hong | F41B 11/80 |
| 10,948,271 | B1 | 3/2021 | Xiaowen et al. | |
| 12,066,269 | B1 * | 8/2024 | Slaughter | F41B 11/71 |
| 2003/0127010 | A1 * | 7/2003 | O'Dwyer | F42B 5/035 102/335 |
| 2010/0083552 | A1 * | 4/2010 | Powers | F42C 19/0823 42/84 |

FOREIGN PATENT DOCUMENTS

| | | | |
|---|---|---|---|
| CA | 3093129 | A1 | 10/2019 |
| CN | 203772152 | U | 8/2014 |
| CN | 103148743 | B | 6/2015 |
| CN | 110332856 | A | 10/2019 |
| CN | 111121548 | A | 5/2020 |
| GB | 2198815 | A | 6/1988 |
| WO | 2010149291 | A1 | 12/2010 |

OTHER PUBLICATIONS

International Preliminary Report on Patentability for Application No. PCT/US2021/021707 dated Sep. 22, 2022 (6 pages).

Canadian Patent Office Action for Application No. 3, 169,690 dated Nov. 18, 2022 (4 pages).

Extended European Search Report for Application No. 21768406.7 dated May 21, 2024 (9 pages).

* cited by examiner

PYROTECHNIC LAUNCH UNITS AND SYSTEMS

PRIORITY CLAIM

The present application is a continuation of U.S. Non-Provisional application Ser. No. 18/192,898, filed on Mar. 30, 2023, which is a continuation of U.S. Non-Provisional application Ser. No. 17/802,366, filed on Aug. 25, 2022, which is a national phase application of International App. No. PCT/US2021/021707, filed on Mar. 10, 2021, which is based on and claims priority to U.S. Provisional App. No. 62/987,991 filed on Mar. 11, 2020, the entire contents of which are incorporated by reference herein.

FIELD

This disclosure pertains to units and systems for launching pyrotechnic elements and, more particularly, to units and systems for launching multiple laser-ignited pyrotechnic elements with precision and in rapid succession.

BACKGROUND

Pyrotechnics are often used for entertainment purposes. For example, brightly colored burning pyrotechnic elements are launched into the air to provide light shows associated with outside concerts, sporting events, and holiday celebrations such as the Fourth of July or New Year's Eve. These elements are made from pyrotechnic compositions including, for example, metallic powders, salts, and other compounds which, when ignited, burn with a predetermined color or with a sparking effect.

The pyrotechnic elements usually include priming elements such as black powder, which is typically applied to the surface of the pyrotechnic elements. Also, pyrotechnic elements for such applications are typically launched using a lifting charge. The lifting charge is ignited with sparks or flames, which light the priming elements, or the priming elements may be separately ignited.

Conventional pyrotechnic systems have a number of drawbacks including the smoke and debris produced by the priming elements and lifting charge, which may be distracting and physically irritating to spectators. Priming elements and lifting charges may also be environmentally undesirable particularly where the debris falls to the ground including soil or bodies of water in and around the launch site. Also, the launch and detonation of the pyrotechnic elements are subject to significant limitations arising from the use of the priming elements and lifting charges, making it difficult if not impossible to launch and ignite successive pyrotechnic elements in short precise periods of time. Finally, the use of black powder priming elements and lifting charges requires special care to avoid injury.

The trajectories and distances traversed by the pyrotechnic elements launched in prior art pyrotechnic systems are imprecise and not generally reproducible, particularly when multiple pyrotechnic elements are launched in succession with short intervals between launches. The lack of precision and repeatability in such prior art systems makes it difficult to produce optimal synchronized pyrotechnic displays.

SUMMARY

Embodiments of the invention comprise apparatuses and systems for launching multiple laser-ignited pyrotechnic elements with precision and in rapid succession.

In one embodiment, a pyrotechnic launch unit includes an elbow module, a first module, and a second module. The elbow module includes a launch barrel, an elbow passage, and a coupling tube. The elbow passage is in communication with the launch barrel. The coupling tube is in communication with the elbow passage. The first module is coupled to the elbow module. The first module includes an output passage, a first slide member, a first delivery passage, a first hopper tube, and a first laser ignition module. The output passage is in communication with the coupling tube. The first slide member includes a first pass-through bore, a first load bore, and a first laser opening. The first laser opening is in communication with the first load bore. Each of the first pass-through bore and the first load bore is in selective communication with the output passage. The first delivery passage is in selective communication with the first load bore. The first hopper tube is in communication with the first delivery passage. The first laser ignition module is configured to project a first laser through the first laser opening. The second module is coupled to the first module. The second module includes a second slide member, a second delivery passage, a second hopper tube, and a second laser ignition module. The second slide member includes a second load bore and a second laser opening. The second laser opening is in communication with the second load bore. The second load bore is in selective communication with the output passage. The second delivery passage is in selective communication with the second load bore. The second hopper tube is in communication with the second delivery passage. The second laser ignition module is configured to project a second laser through the second laser opening.

In one embodiment, a modular pyrotechnic launch unit includes a launch module, a first module, and a second module. The launch module includes a launch barrel. The first module is coupled in series to the launch module. The first module includes a first ignition state in which the first module is configured to ignite a pyrotechnic element that will then pass through the launch barrel. The first module also includes a first pass-through state in which the first module is configured to allow a pyrotechnic element ignited by another module to pass through the first module. The second module is coupled in series to the first module. The second module includes a second ignition state in which the second module is configured to ignite a pyrotechnic element that will then pass through the first module and through the launch barrel.

In one embodiment, a pyrotechnic launch unit includes an elbow module, a front module, a first slide retaining block, a second slide retaining block, and a rear module. The front module and the rear module each have a chamber for receiving a pyrotechnic element from a hopper loaded with pyrotechnic elements. A hopper is mounted to each of the front and rear modules to provide successive elements for loading and launching. A slide mechanism located in the slide retaining block receives the successive pyrotechnic elements and transports them to a launch position.

A laser ignition module is attached to each slide retainer. This module preferably is positioned so that the laser is about 0.75 to 1.0 inch above the pyrotechnic element in the slide mechanism after it has entered its launch position. The laser beam passes through a channel to minimize "blowback" from the pyrotechnic elements once ignited and also to minimize air loss during the launch. The laser beam will be focused so that it contacts sufficient surface area of the pyrotechnic element to ensure proper ignition.

Preferably, the laser ignition module will have a fixed focal length. It should be mounted so that the laser beam stays in focus and remains aligned with the channel through which it is fired. Preferably the laser will be a pulsed laser diode with a wavelength in the range of about 300 nm to 495 nm. Currently, the preferred wavelength is believed to be about 445 nm.

Embodiments also include a regulated air supply that is activated each time a pyrotechnic element is in the launch position to thrust the pyrotechnic element with a blast of air. The regulated air supply is variable so that the force of air may be adjusted as desired to launch the pyrotechnic element at as precise an altitude and as precise a velocity as desired. A launch apex of between 15 and 85 feet may, for example, be achieved with the current embodiments. Yet higher launches may also be achieved. The use of a blast of air to thrust the pyrotechnic element into the air in lieu of the more conventional black powder lifting charge is highly desirable because, among other things, it eliminates the smoke and debris produced by conventional systems.

DETAILED DESCRIPTION

Figure 1:
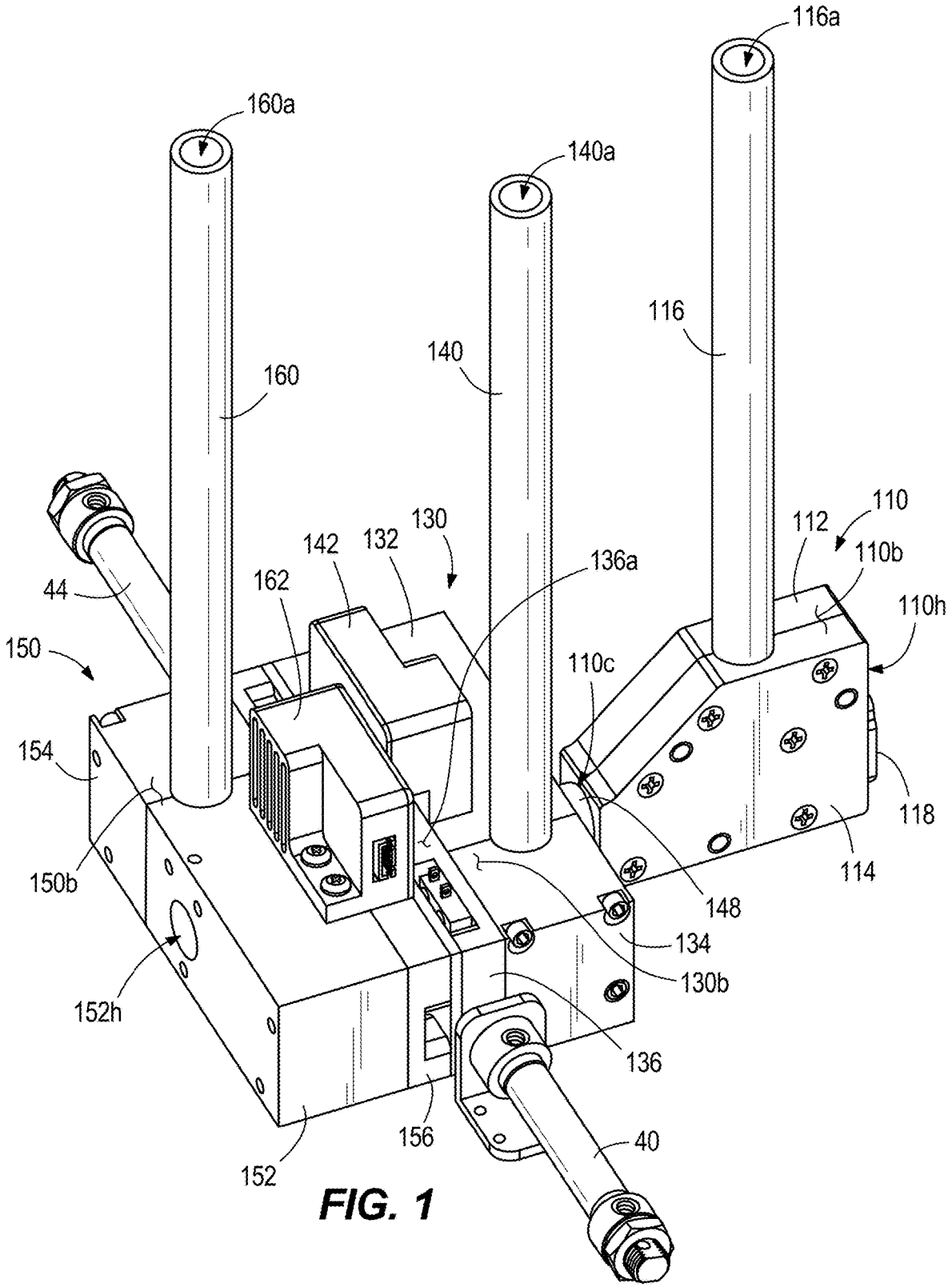
FIG. 1 illustrates an isometric view of a pyrotechnic launch unit according to embodiments disclosed herein.
Figure 2:
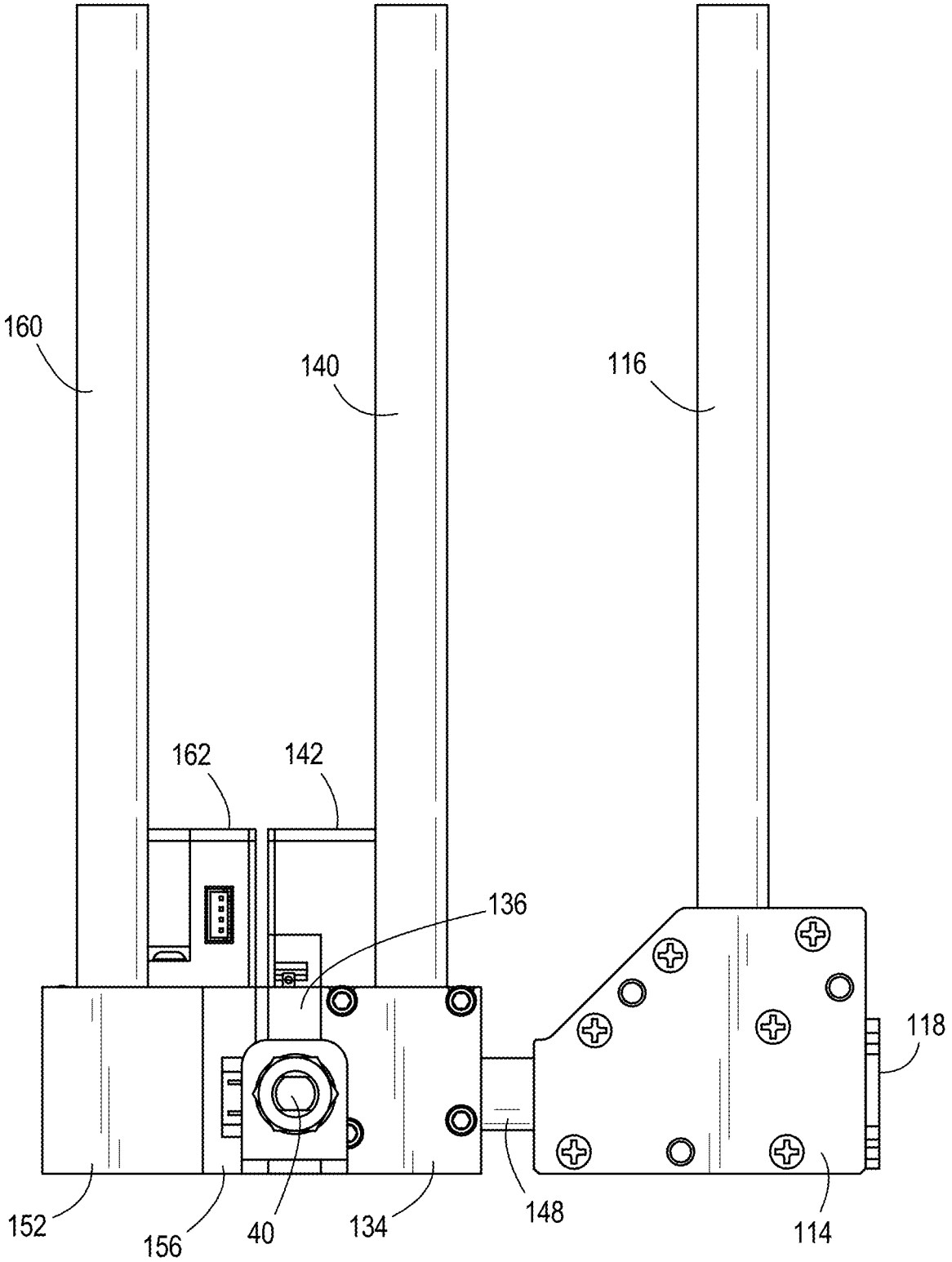
FIG. 2 illustrates a right side elevation view of the pyrotechnic launch unit of FIG. 1.
Figure 3:
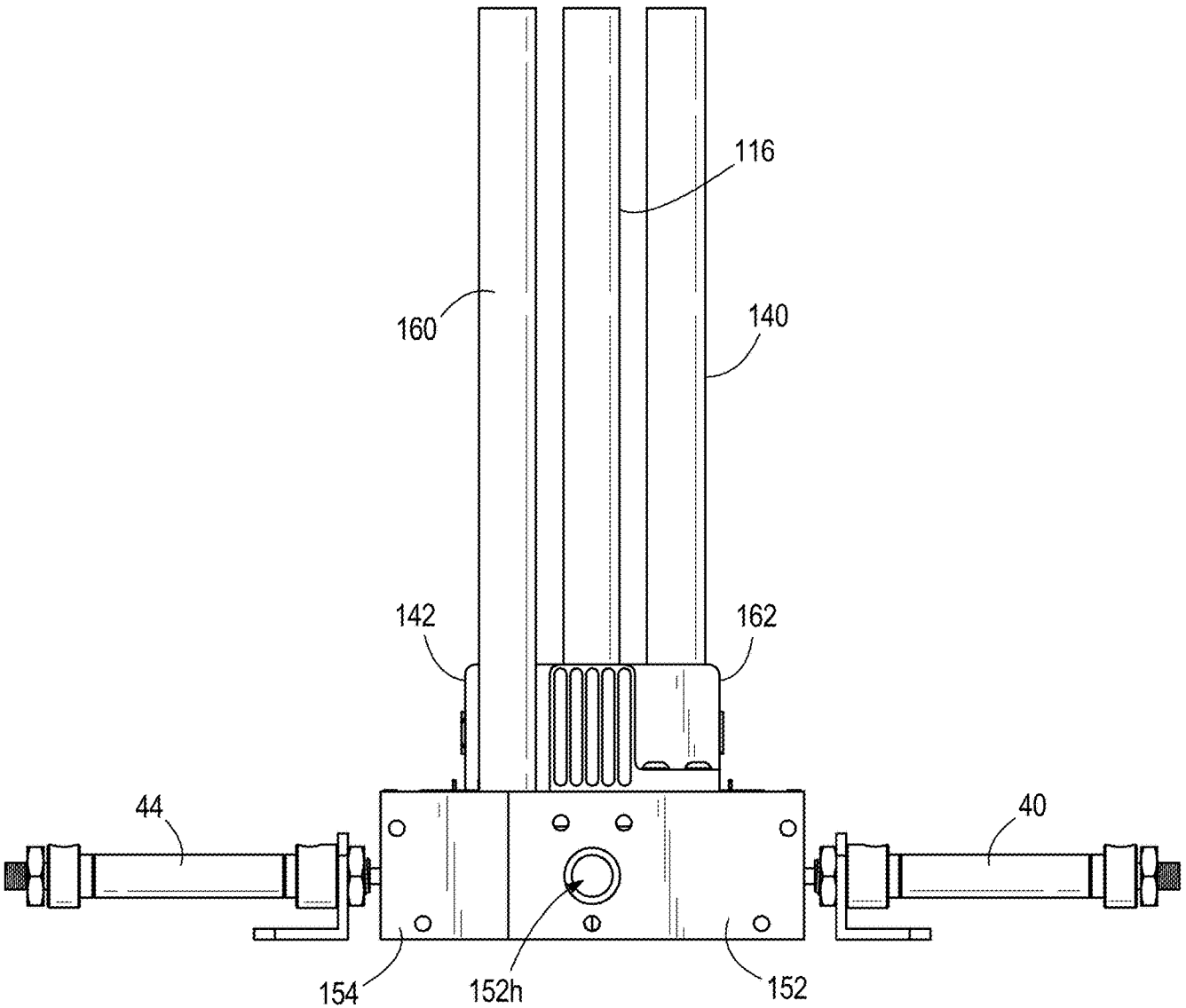
FIG. 3 illustrates a rear elevation view of the pyrotechnic launch unit of FIG. 1.
Figure 4:
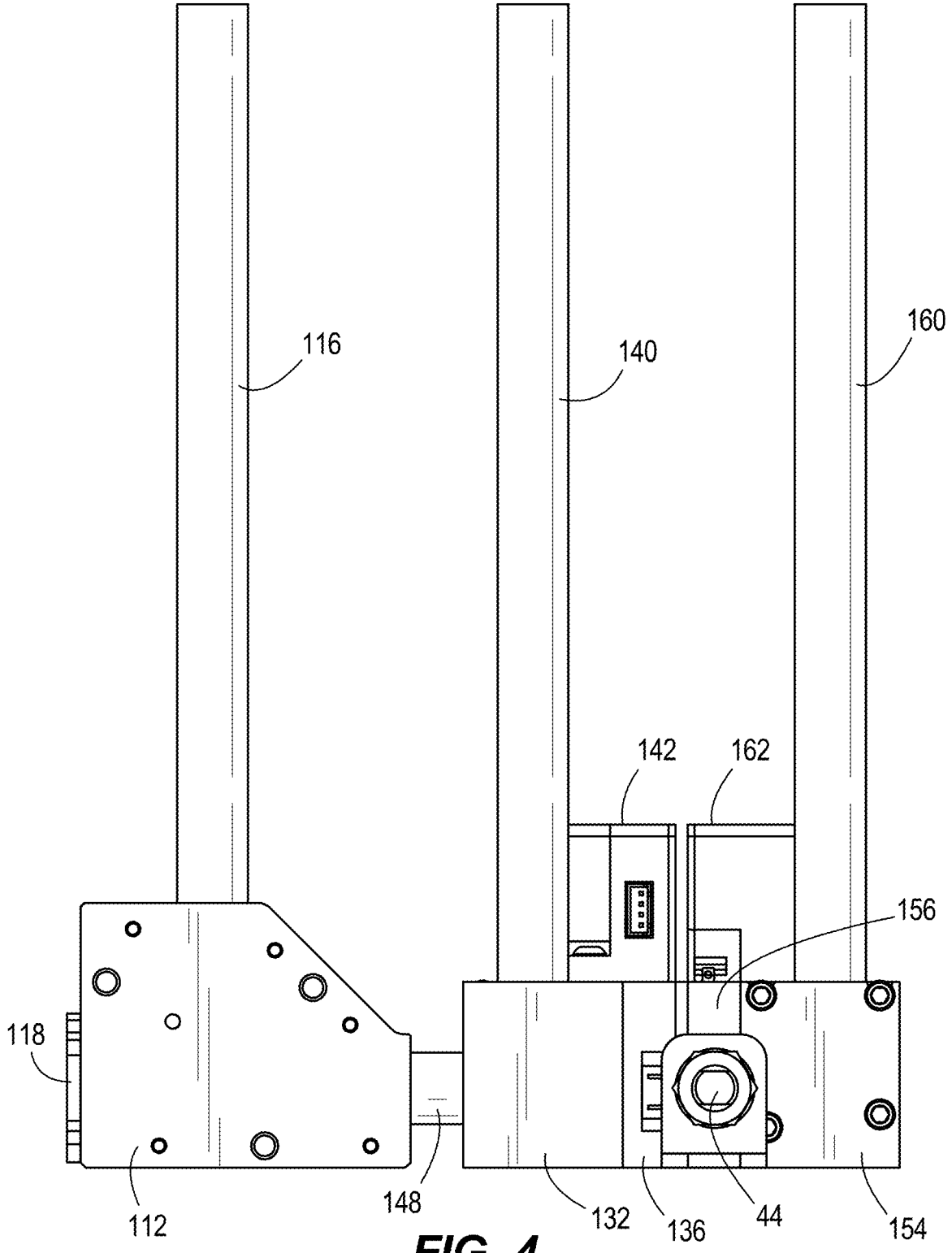
FIG. 4 illustrates a right side elevation view of the pyrotechnic launch unit of FIG. 1.
Figure 5:
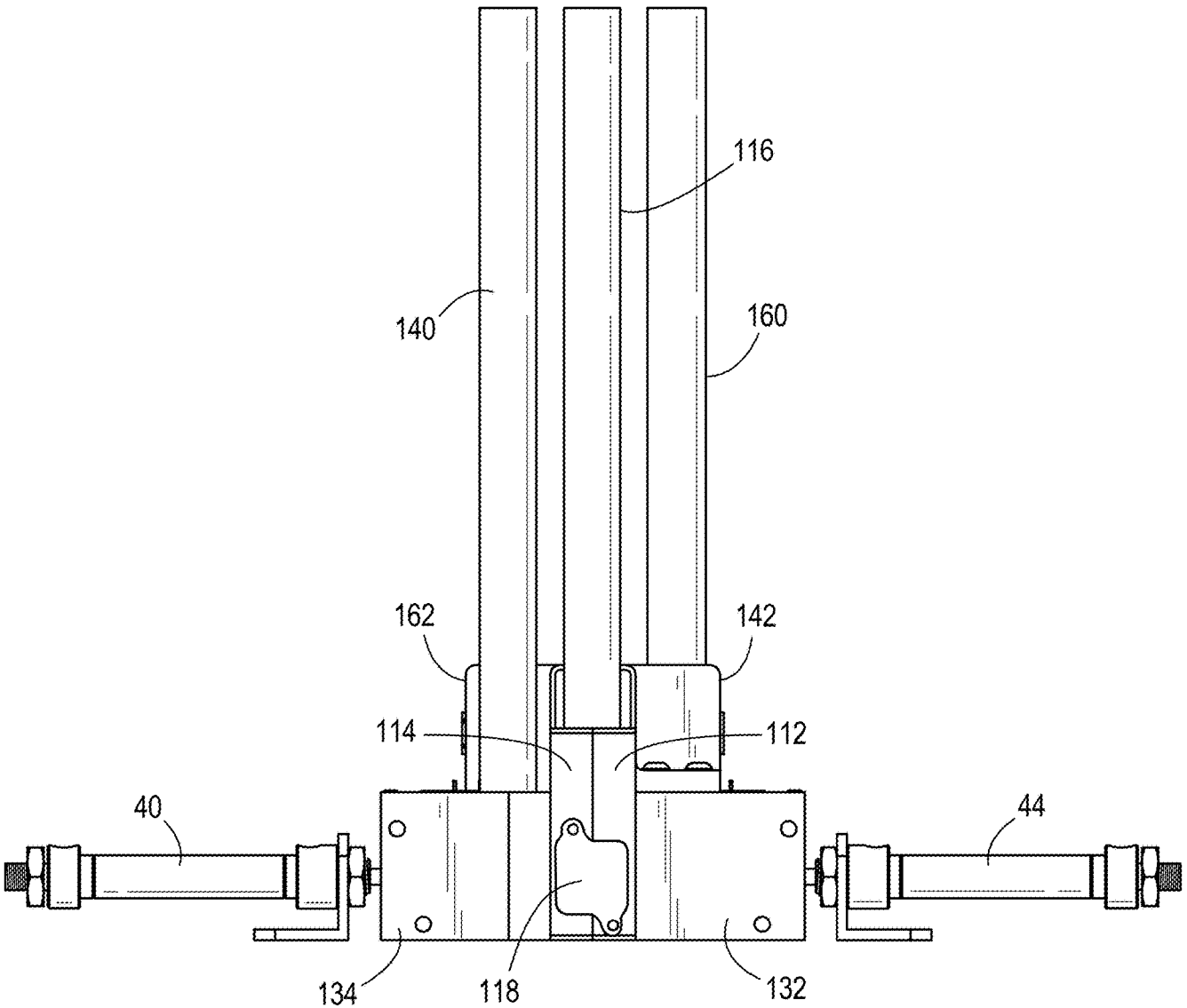
FIG. 5 illustrates a front elevation view of the pyrotechnic launch unit of FIG. 1.
Figure 6:
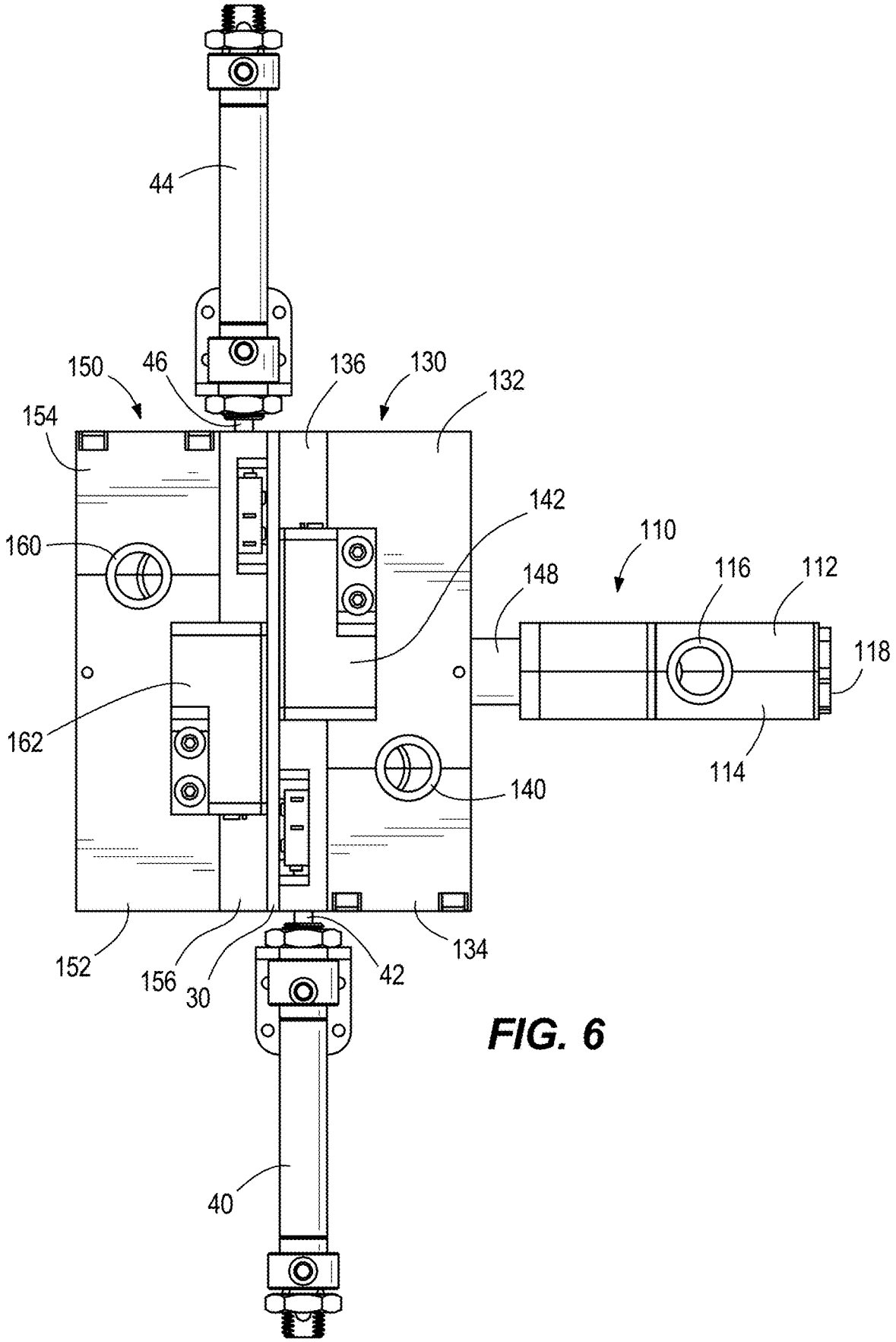
FIG. 6 illustrates a top plan view of the pyrotechnic launch unit of FIG. 1.
Figure 7:
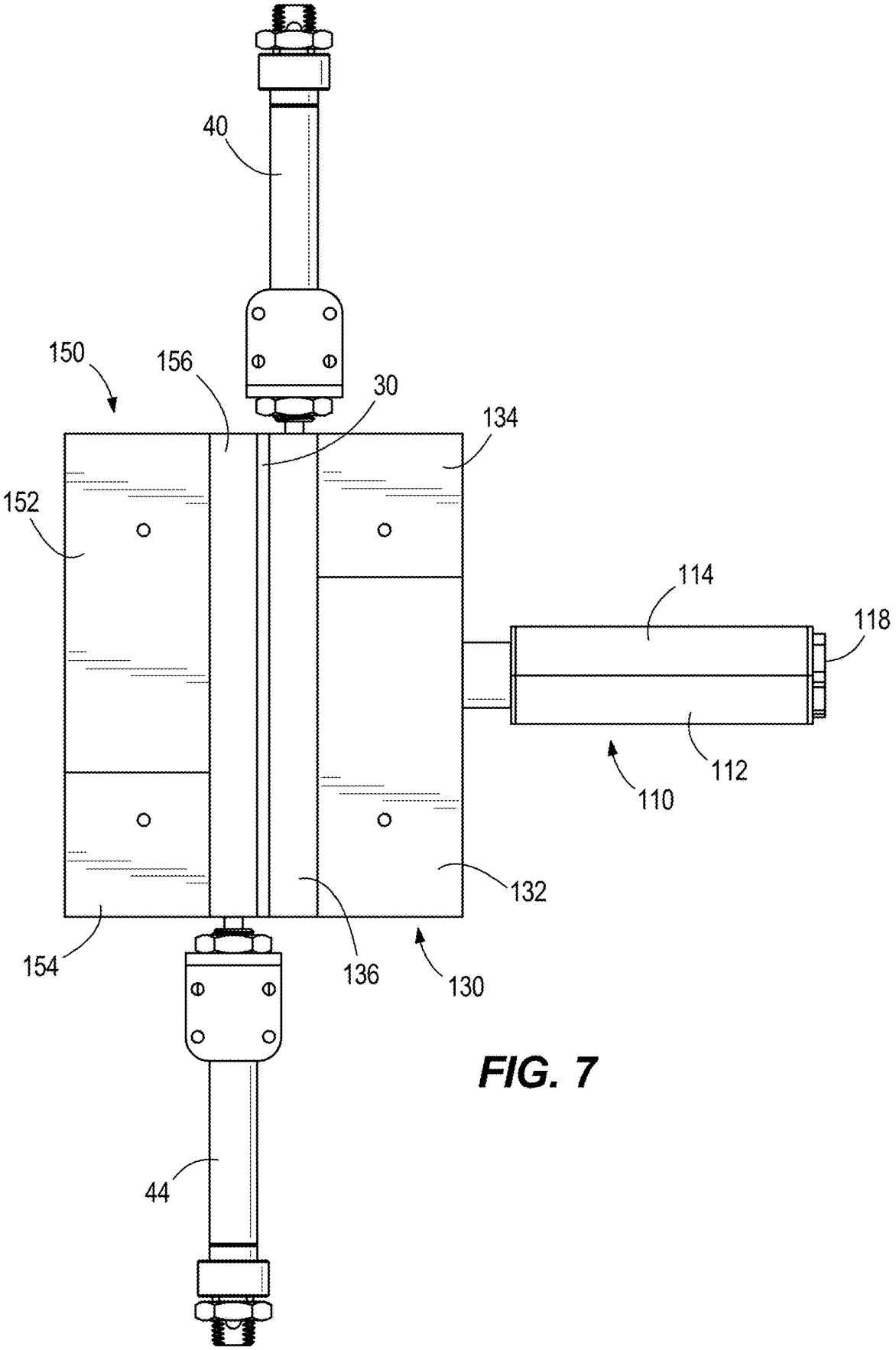
FIG. 7 illustrates a bottom plan view of the pyrotechnic launch unit of FIG. 1.
Figure 8:
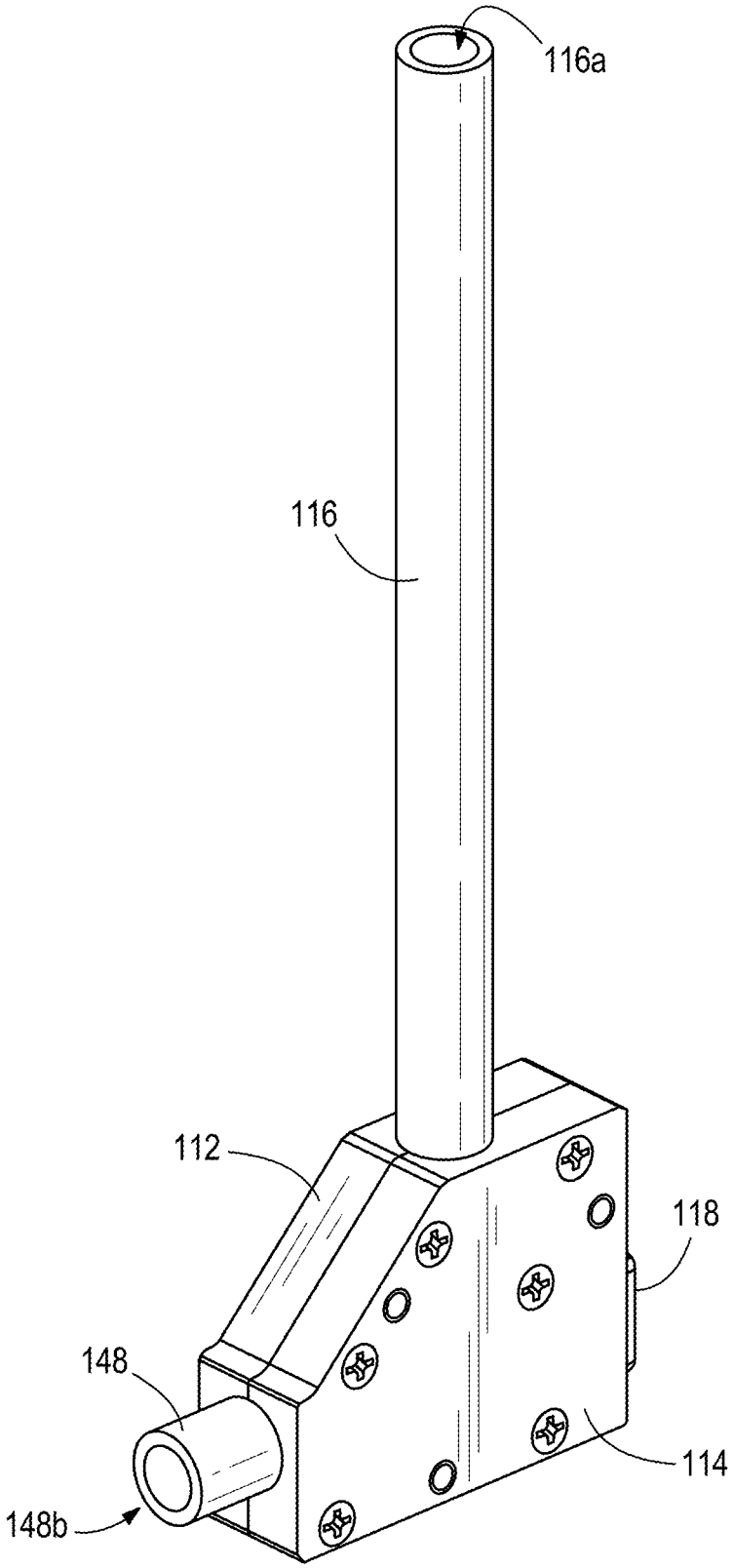
FIG. 8 illustrates an isometric view of an elbow module of the pyrotechnic launch unit of FIG. 1.
Figure 9:
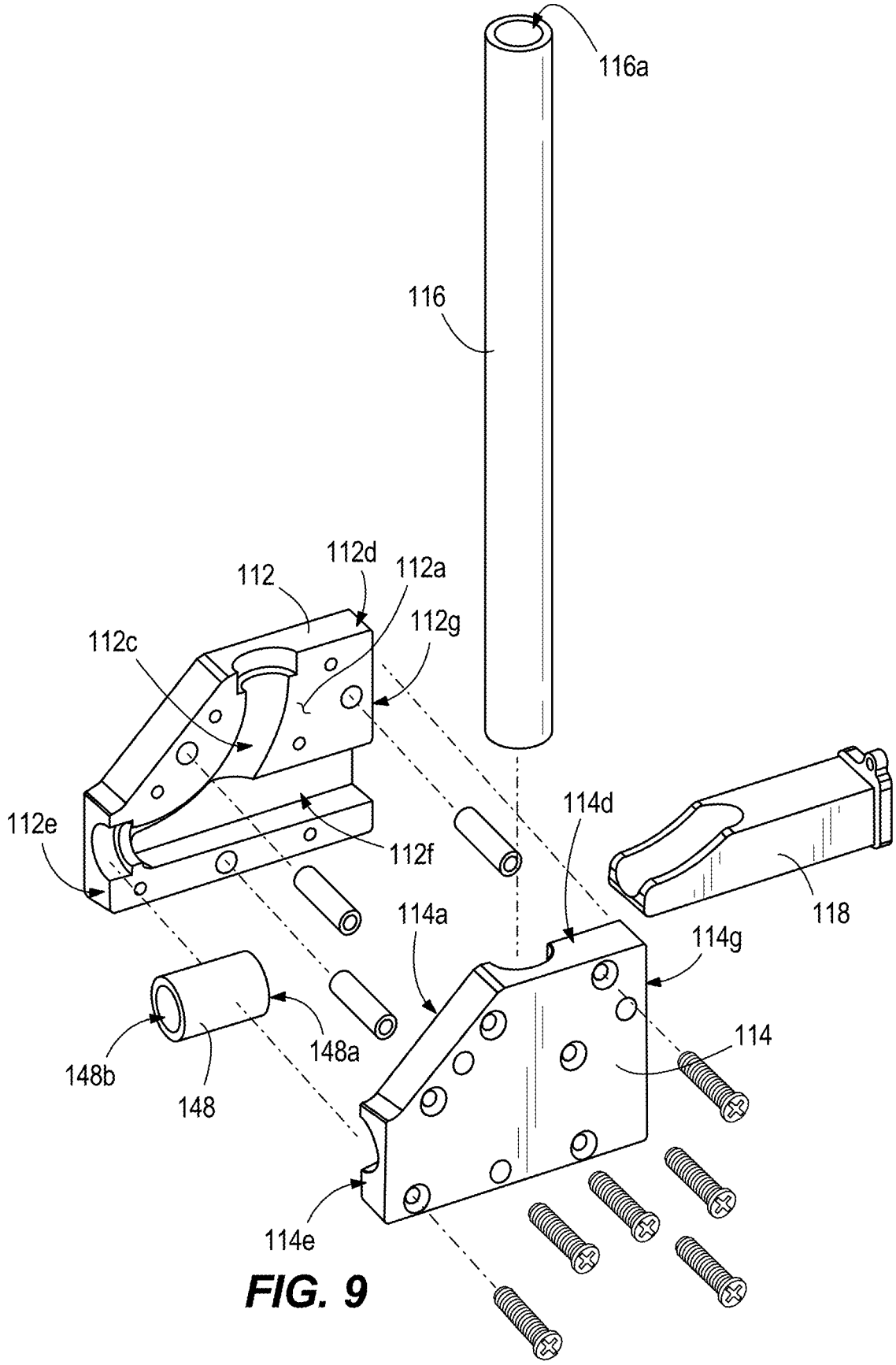
FIG. 9 illustrates an exploded isometric view of the elbow module of FIG. 8.
Figure 10:
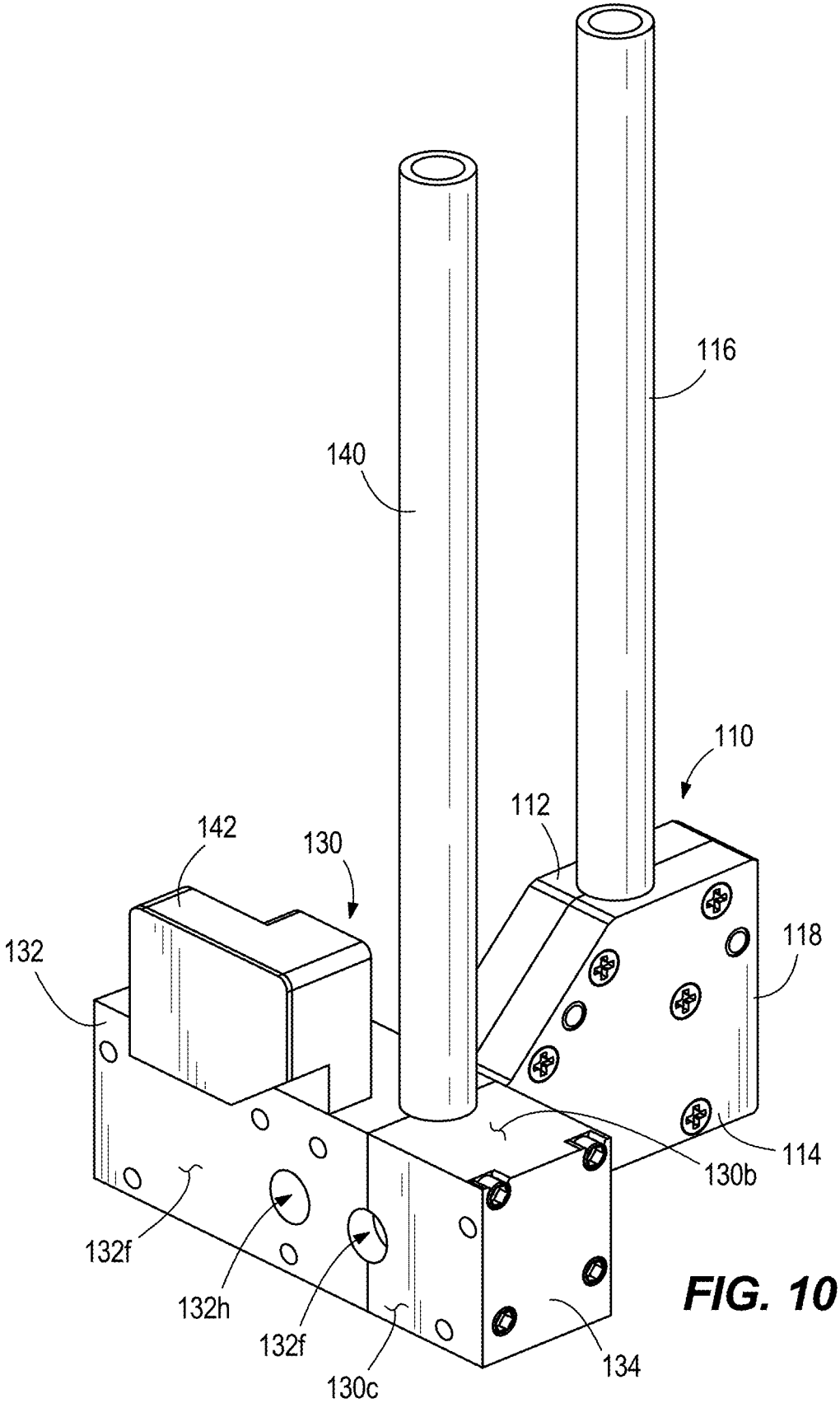
FIG. 10 illustrates an isometric view of the elbow module and a portion of the first module of the pyrotechnic launch unit of FIG. 1.
Figure 11:
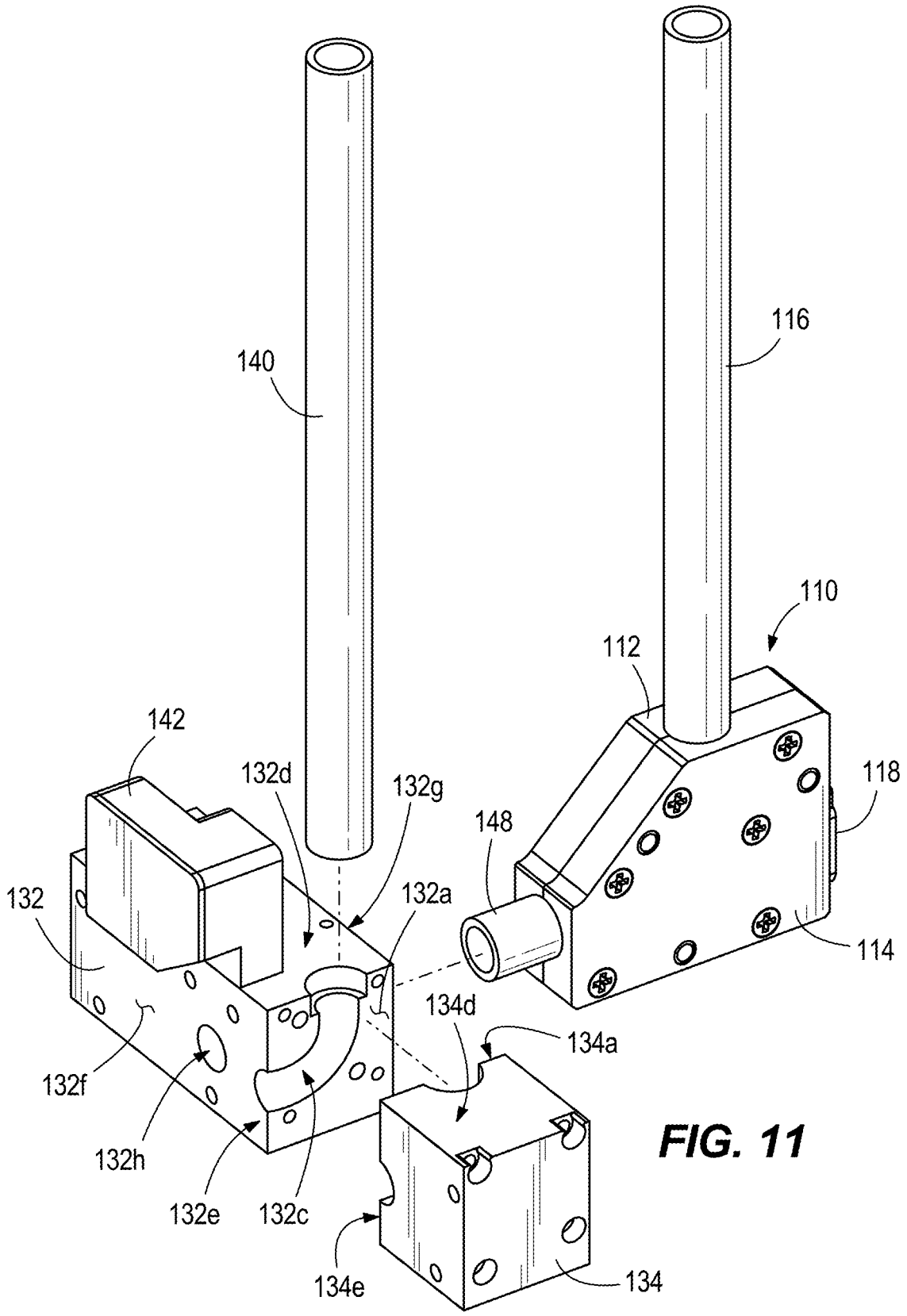
FIG. 11 illustrates an exploded isometric view of the elbow module and the portion of the first module of FIG. 10.
Figure 12:
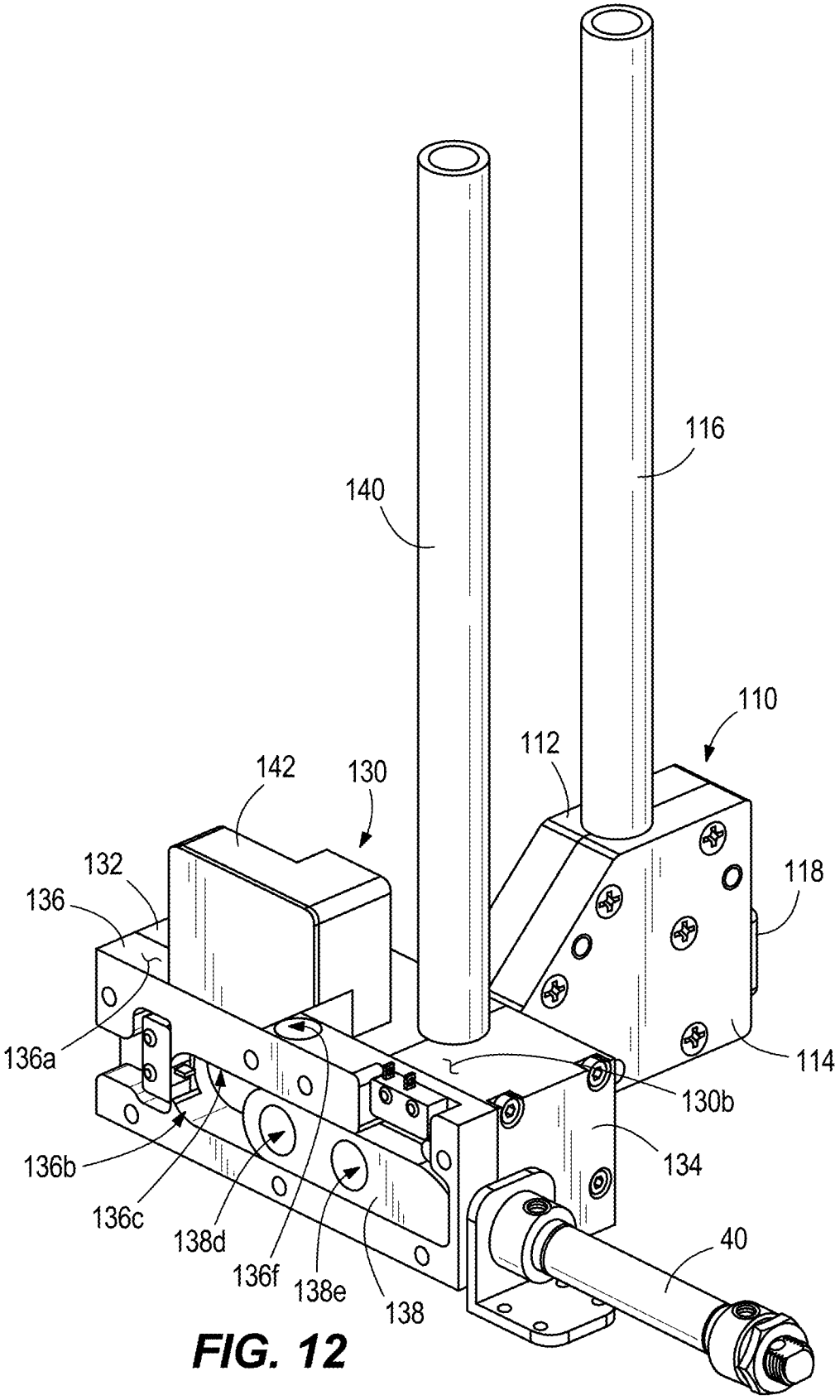
FIG. 12 illustrates an isometric view of the elbow module and the first module of the pyrotechnic launch unit of FIG. 1.
Figure 13:
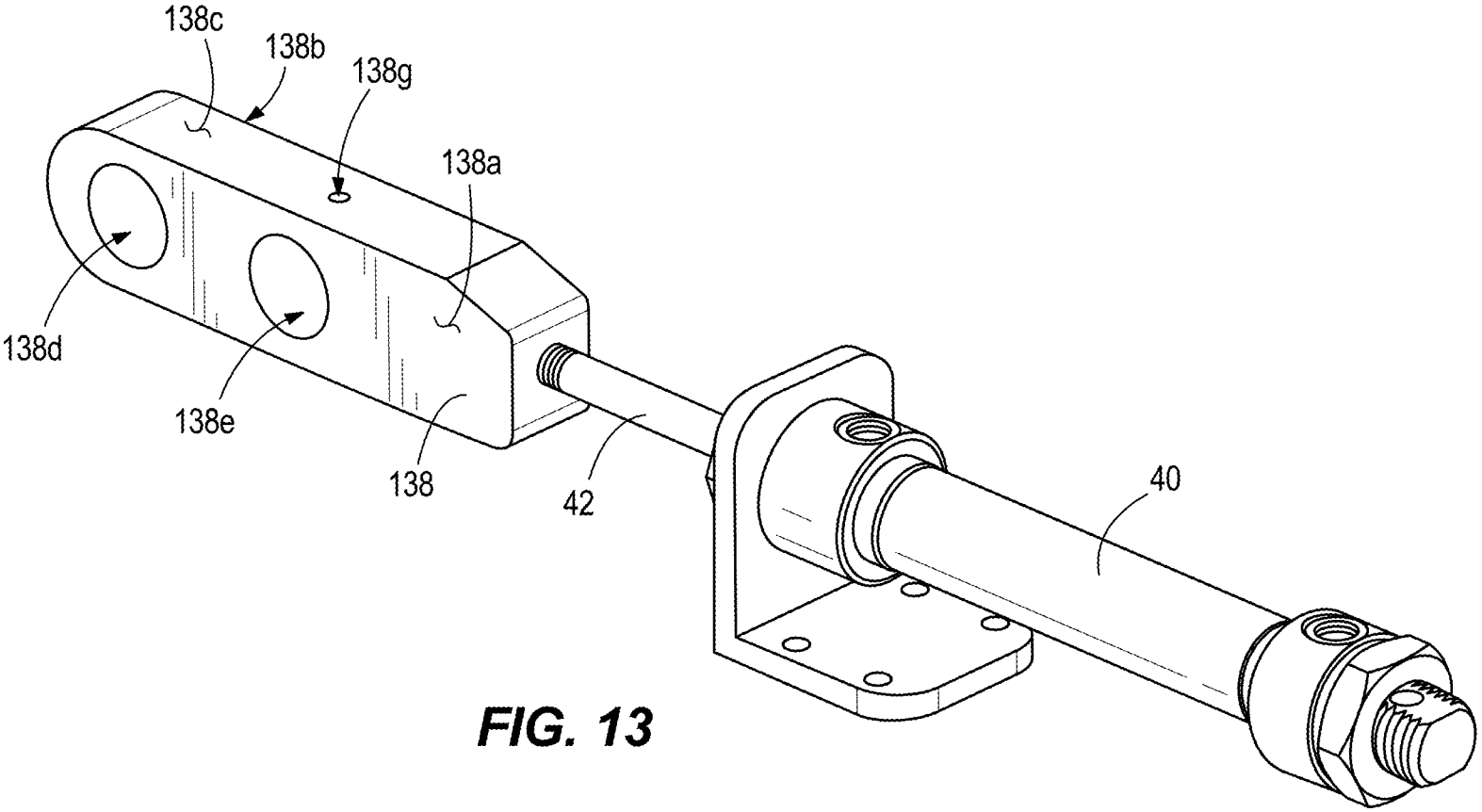
FIG. 13 illustrates an isometric view of a first slide member of the first module of FIG. 12.
Figure 14:
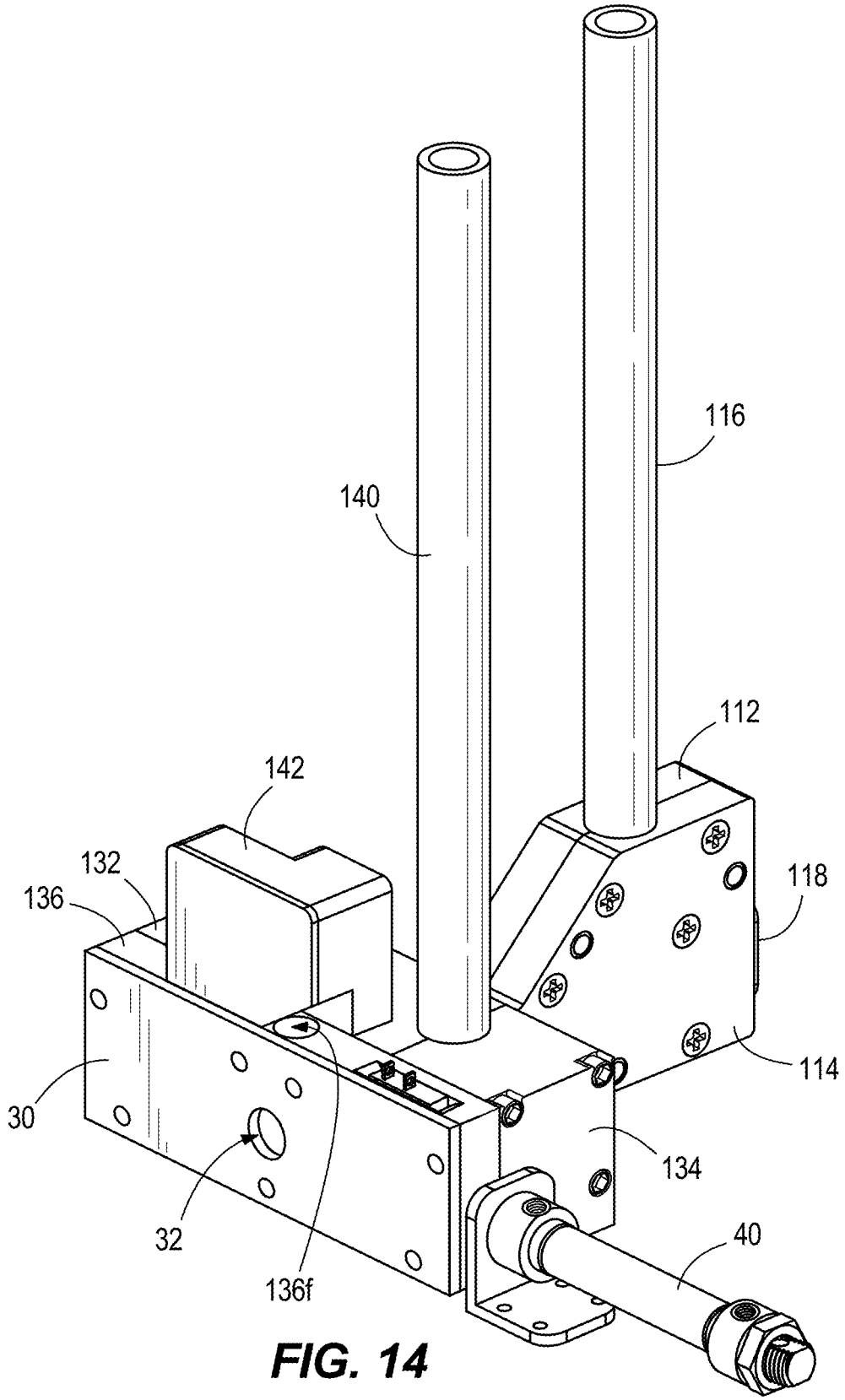
FIG. 14 illustrates an isometric view of the elbow module, the first module, and a retainer plate of the pyrotechnic launch unit of FIG. 1.
Figure 15:
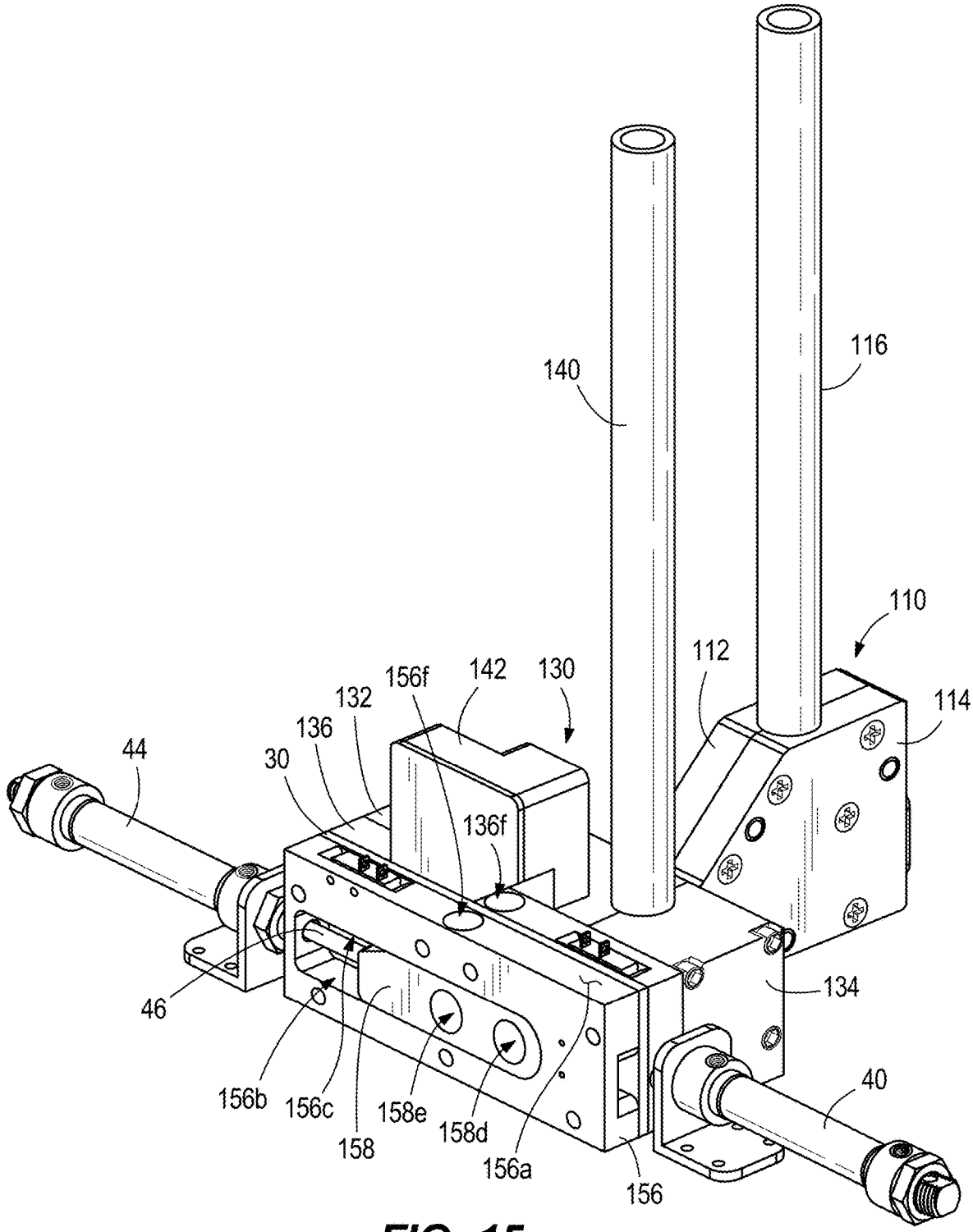
FIG. 15 illustrates an isometric view of the elbow module, the first module, the retainer plate, and a portion of the second module of the pyrotechnic launch unit of FIG. 1.
Figure 16:
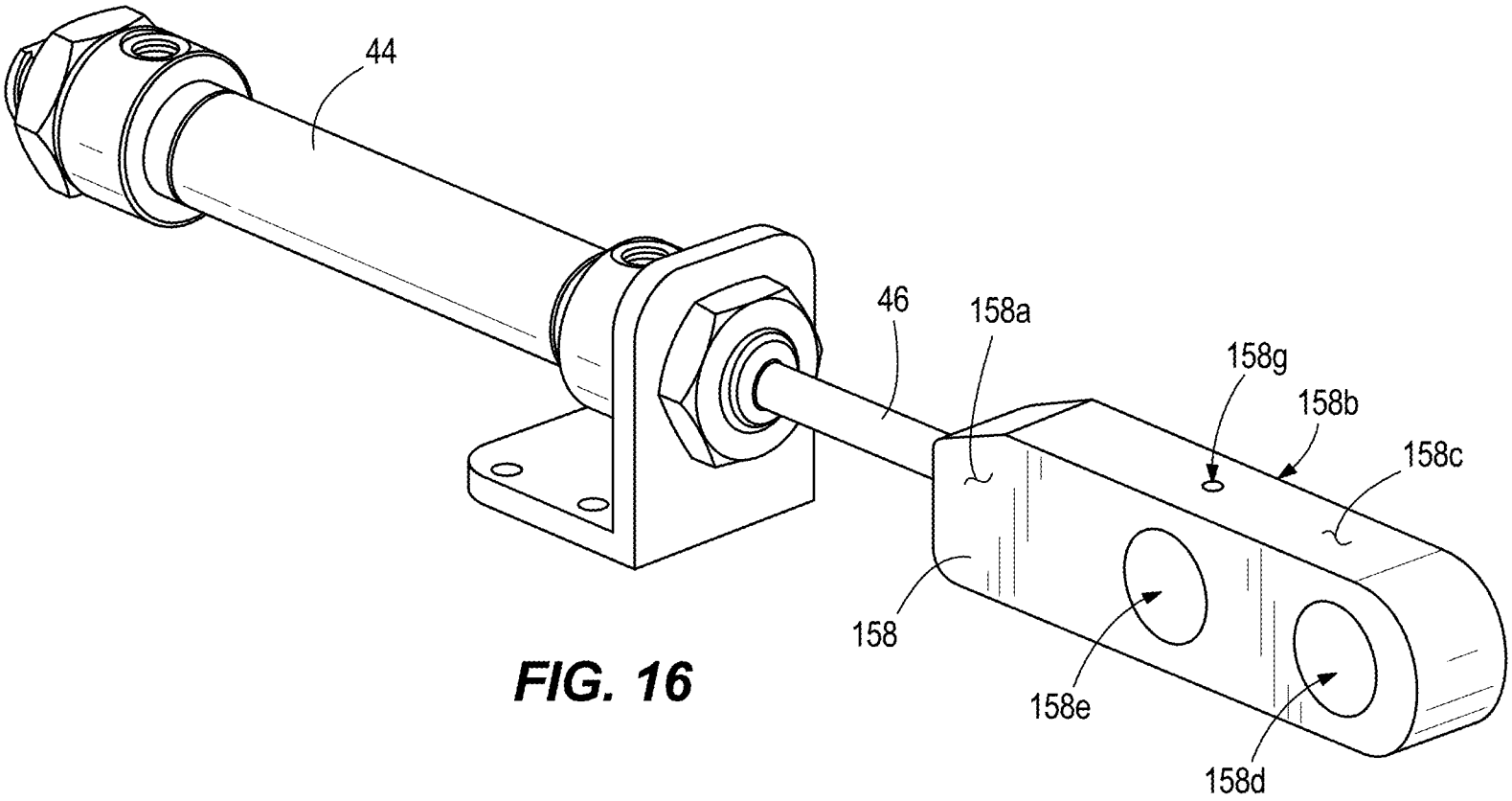
FIG. 16 illustrates an isometric view of a second slide member of the second module of the pyrotechnic launch unit of FIG. 1.
Figure 17:
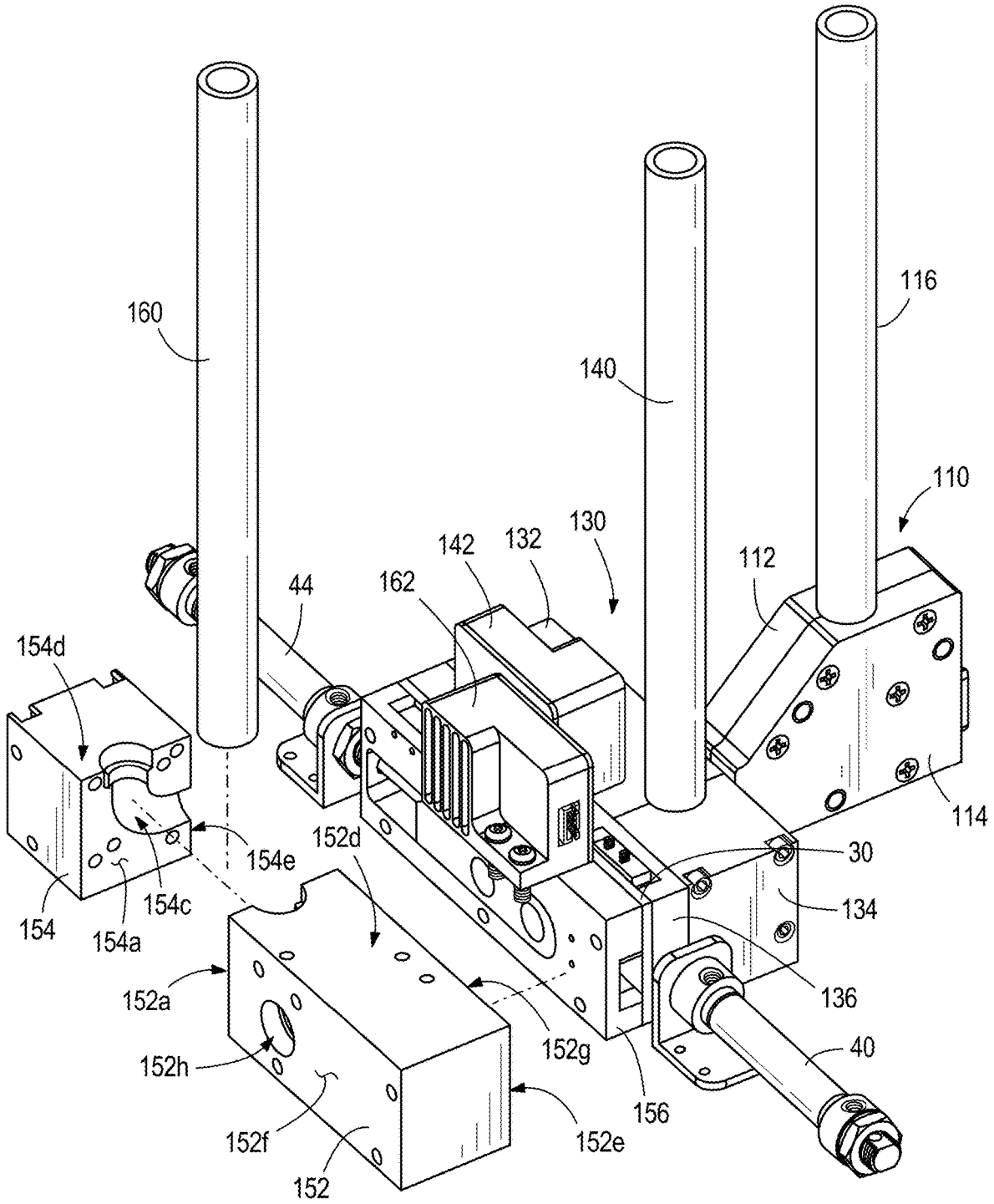
FIG. 17 illustrates a partially exploded isometric view of the pyrotechnic launch unit of FIG. 1.
Figure 18:
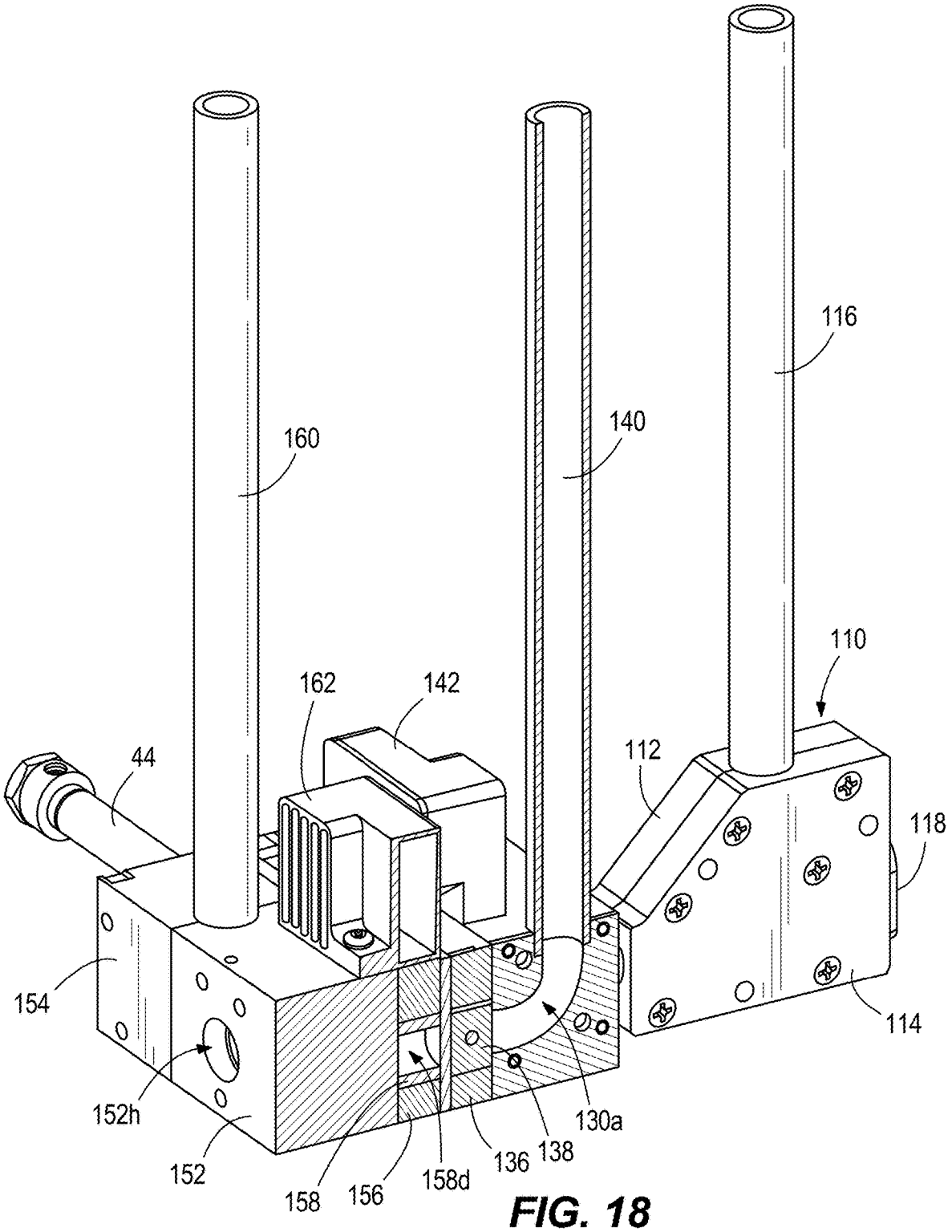
FIG. 18 illustrates an isometric cross-sectional view of the pyrotechnic launch unit of FIG. 1.
Figure 19:
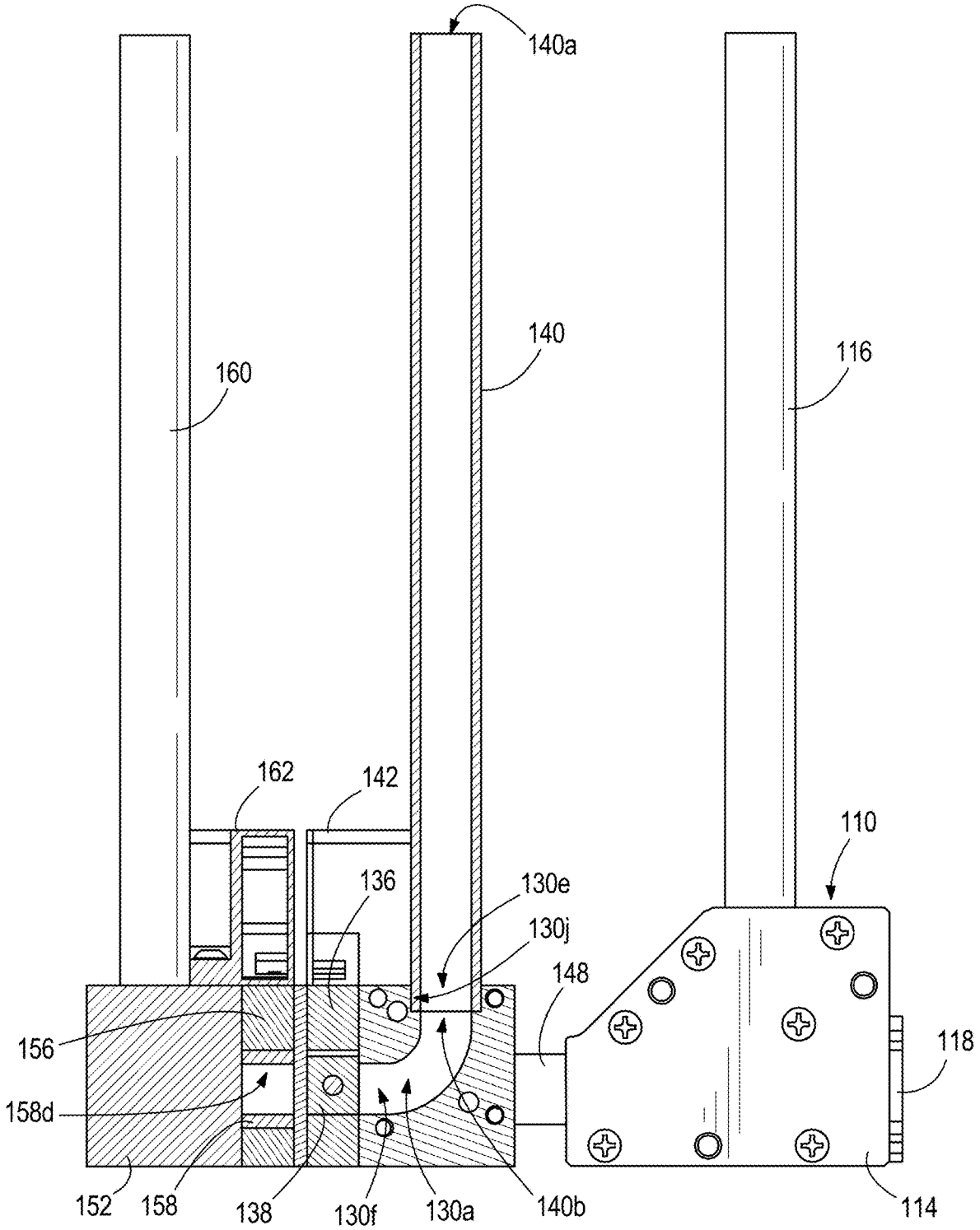
FIG. 19 illustrates a right side elevation view of the cross-section of FIG. 18.
Figure 20:
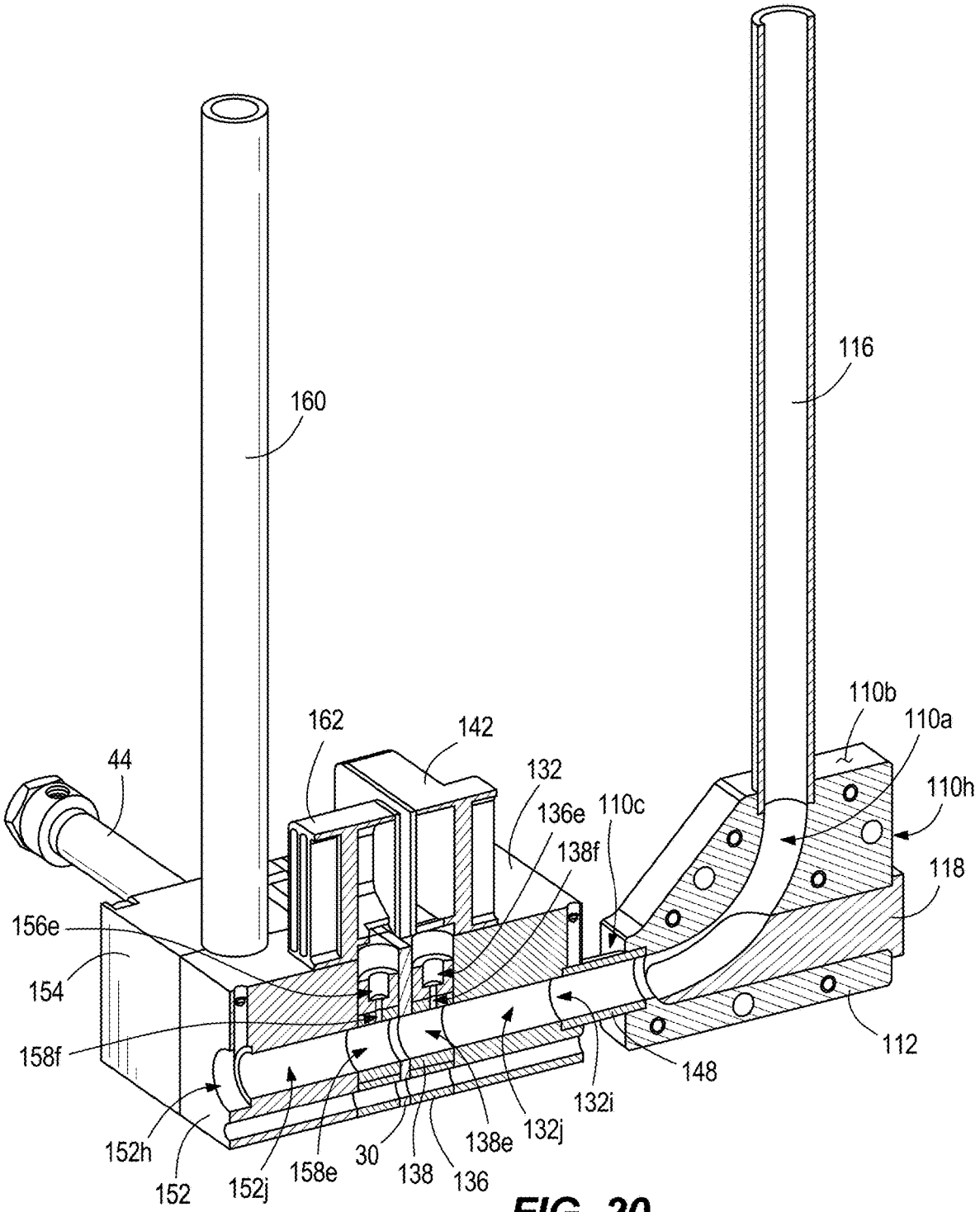
FIG. 20 illustrates another isometric cross-sectional view of the pyrotechnic launch unit of FIG. 1.
Figure 21:
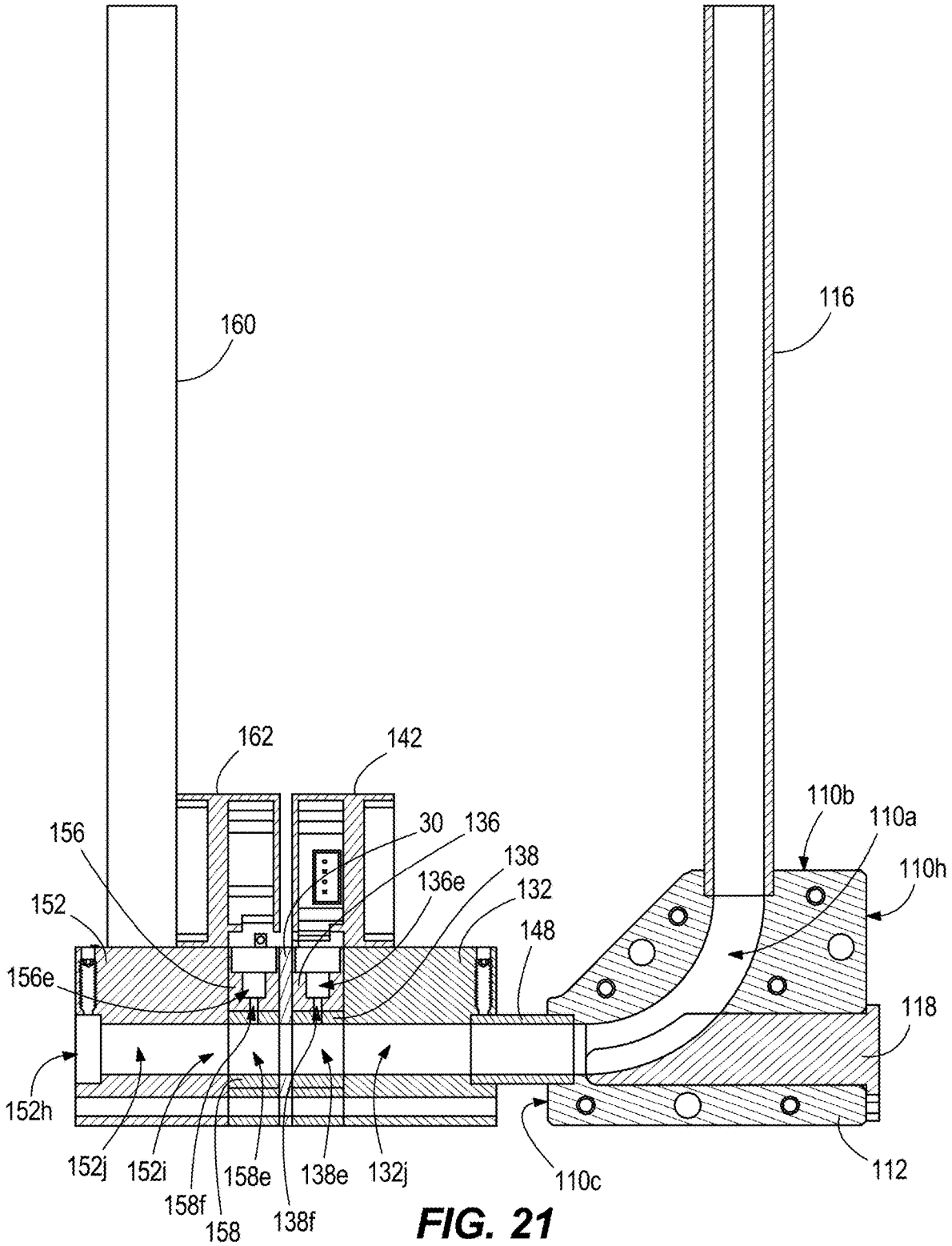
FIG. 21 illustrates a right side elevation view of the cross-section of FIG. 20.
Figure 22:
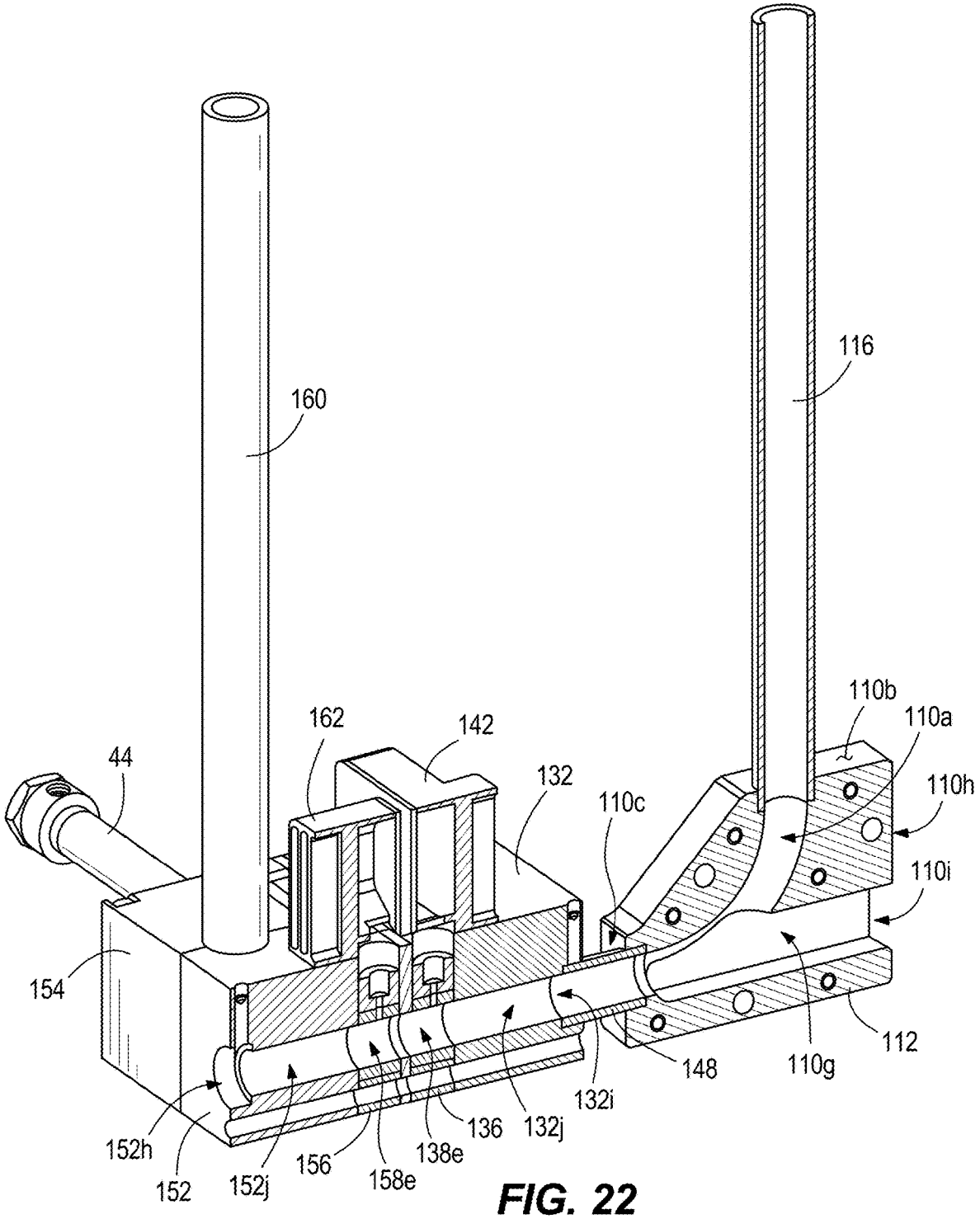
FIG. 22 illustrates another isometric cross-sectional view of the pyrotechnic launch unit of FIG. 1.
Figure 23:
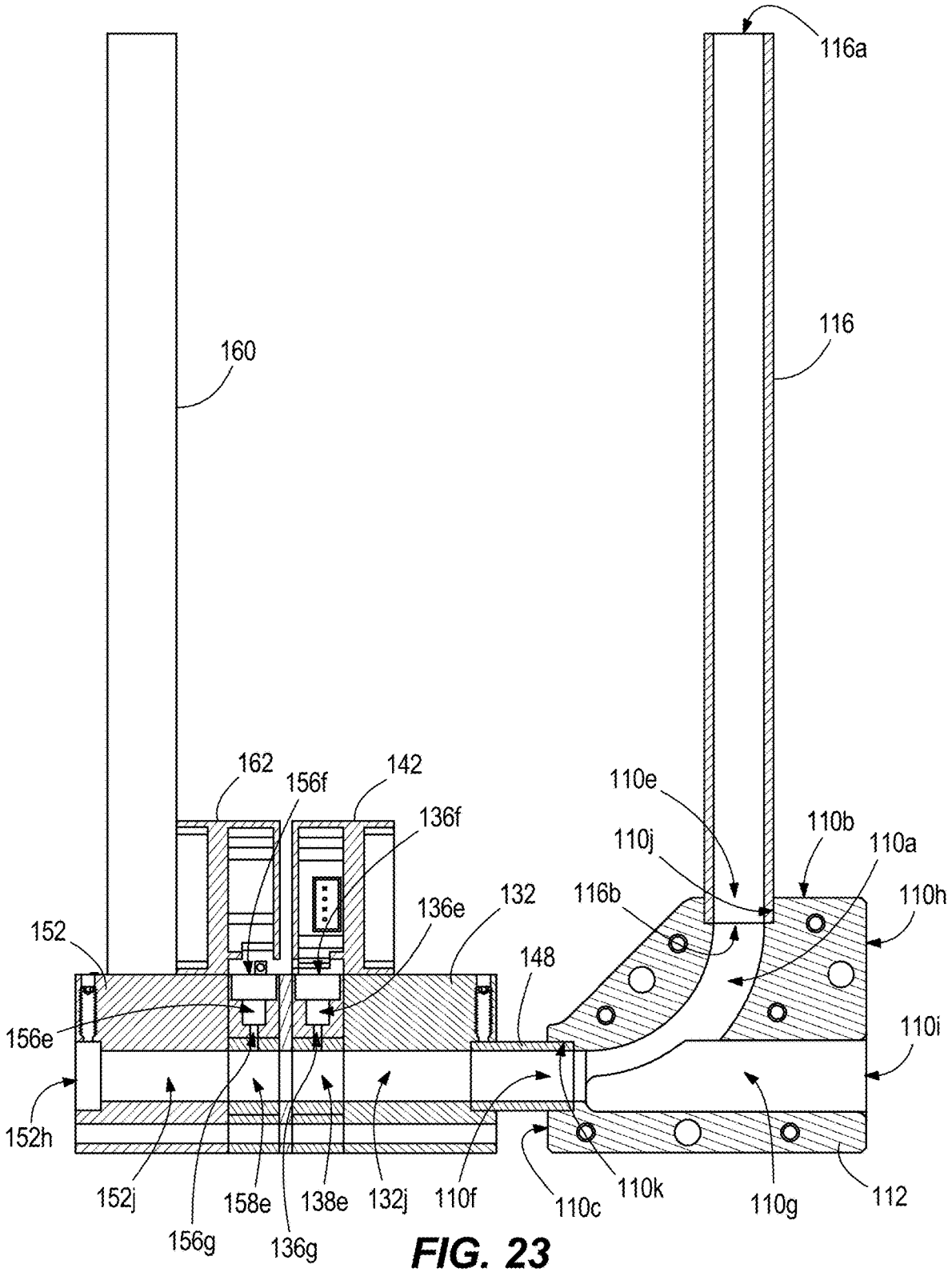
FIG. 23 illustrates a right side elevation view of the cross-section of FIG. 22.
Figure 24:
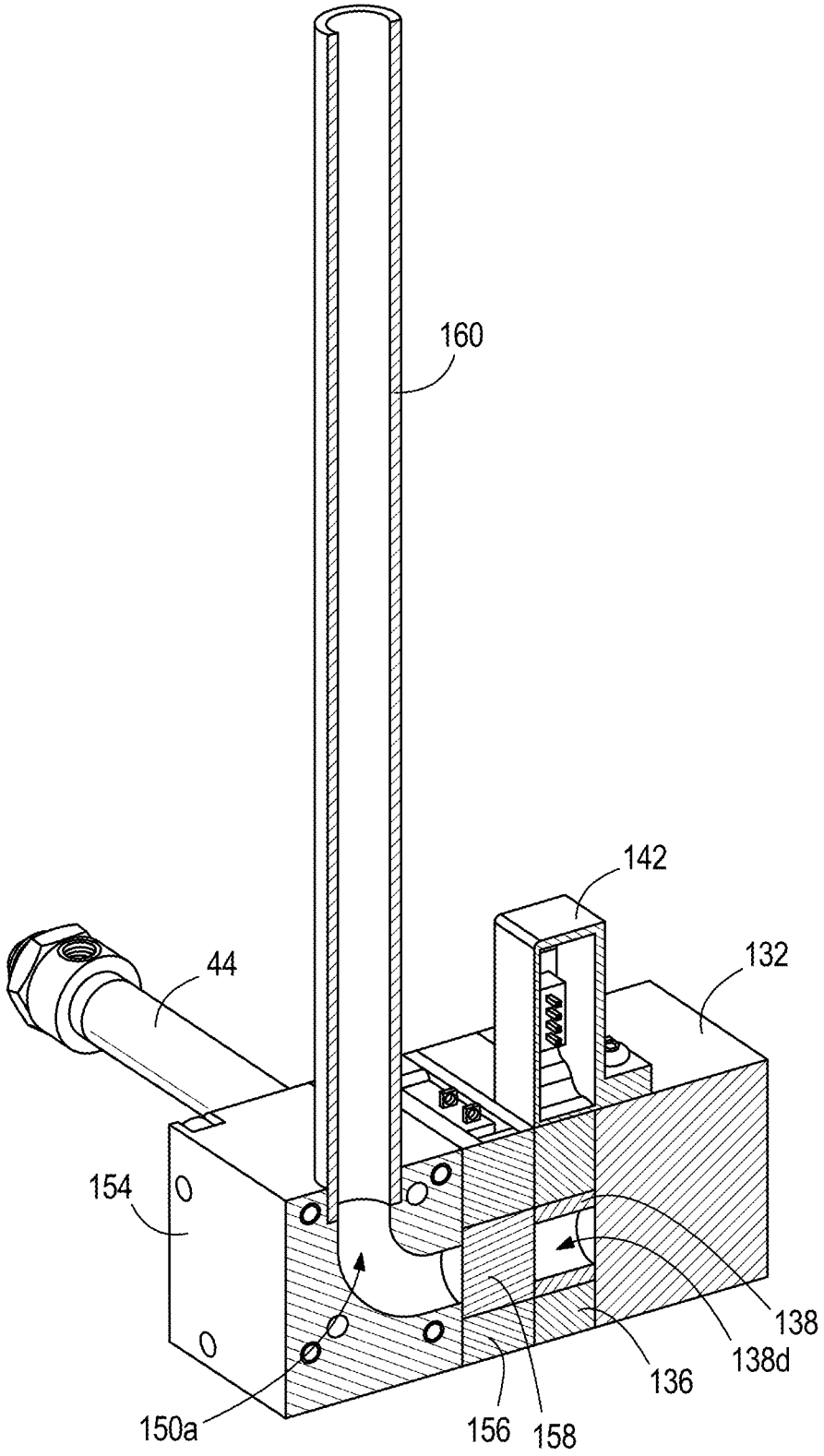
FIG. 24 illustrates another isometric cross-sectional view of the pyrotechnic launch unit of FIG. 1.
Figure 25:
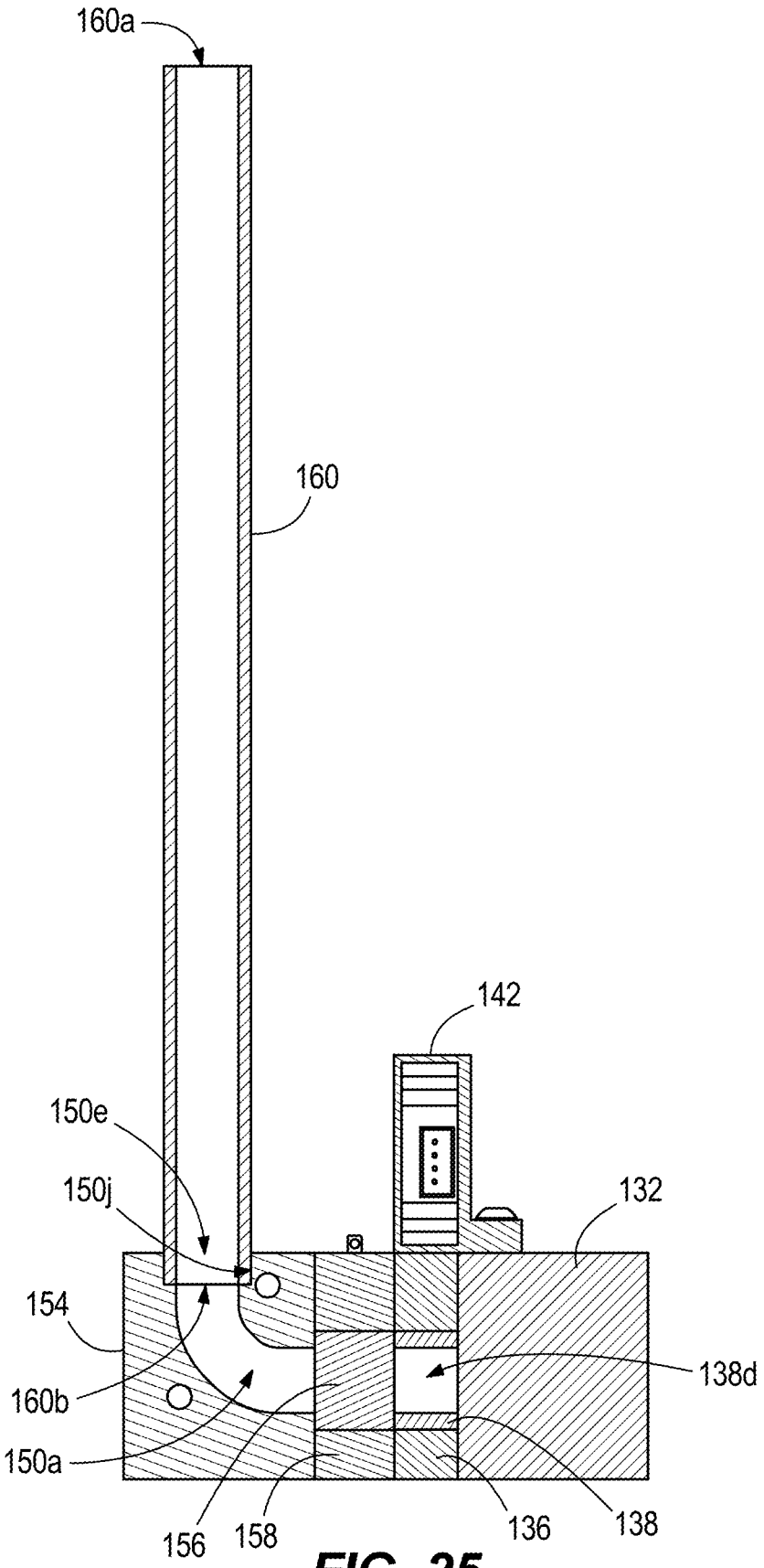
FIG. 25 illustrates a right side elevation view of the cross-section of FIG. 24.
Figure 26:
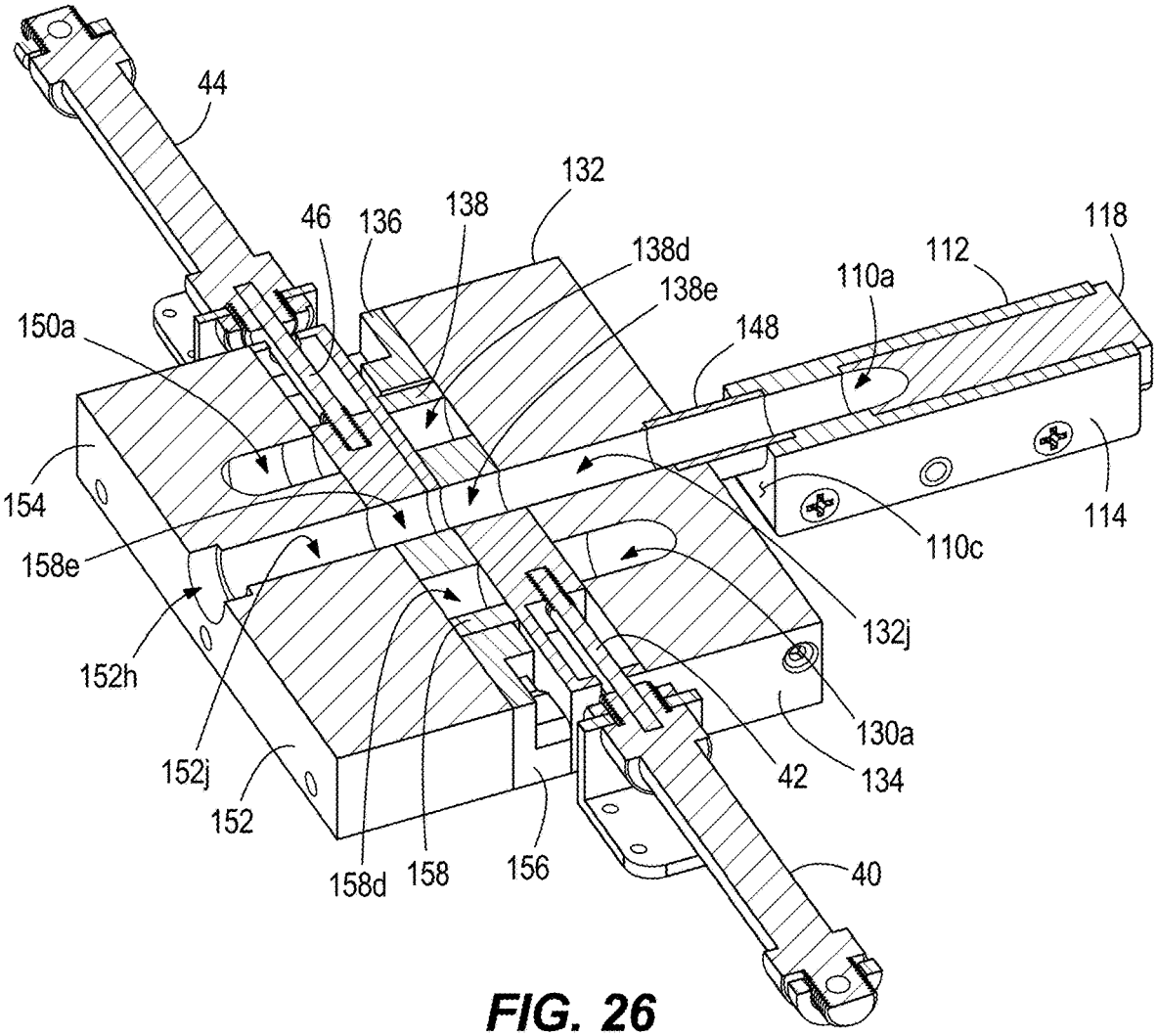
FIG. 26 illustrates another isometric cross-sectional view of the pyrotechnic launch unit of FIG. 1.
Figure 27:
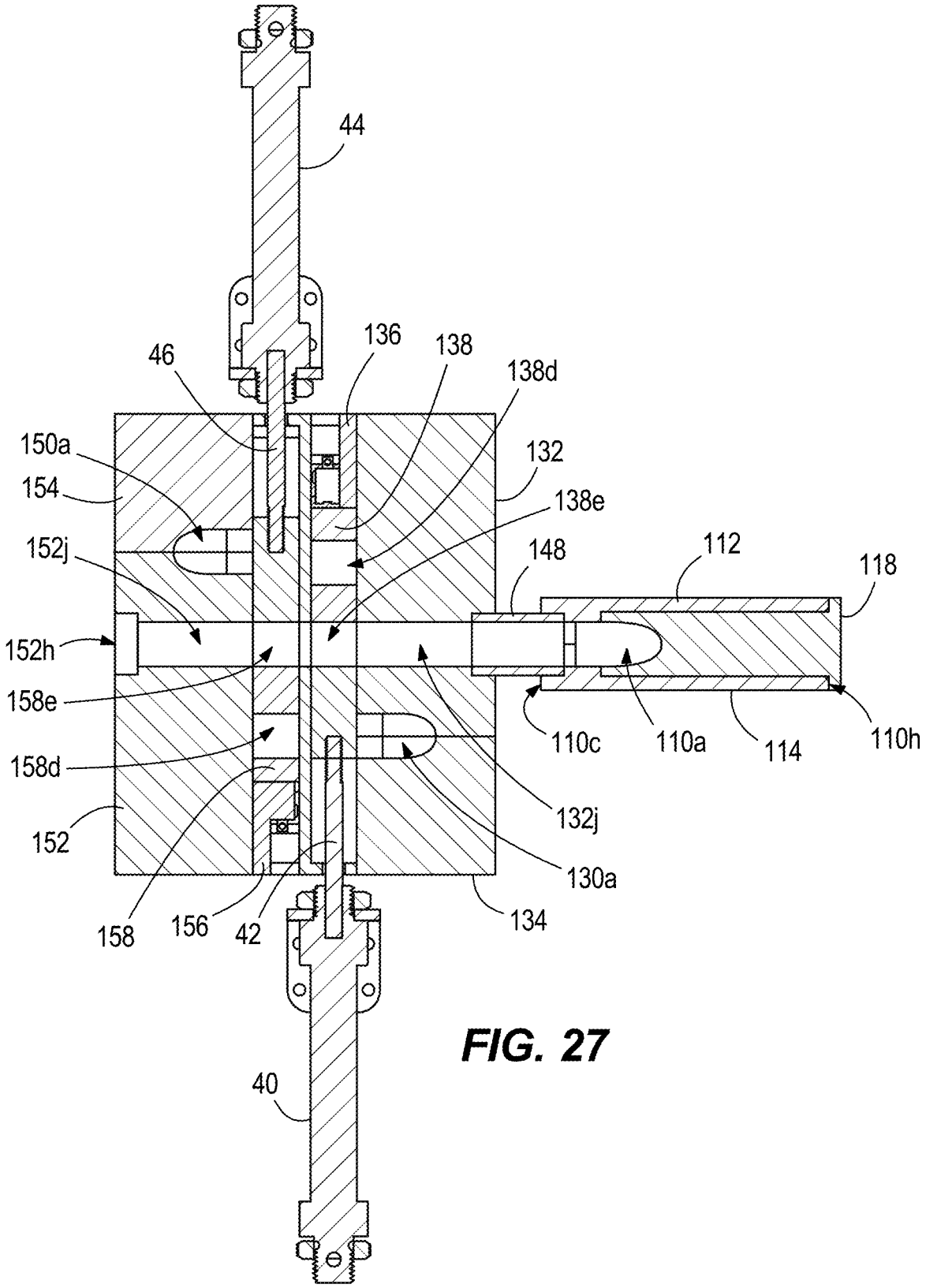
FIG. 27 illustrates a top plan view of the cross-section of FIG. 26.
Figure 28:
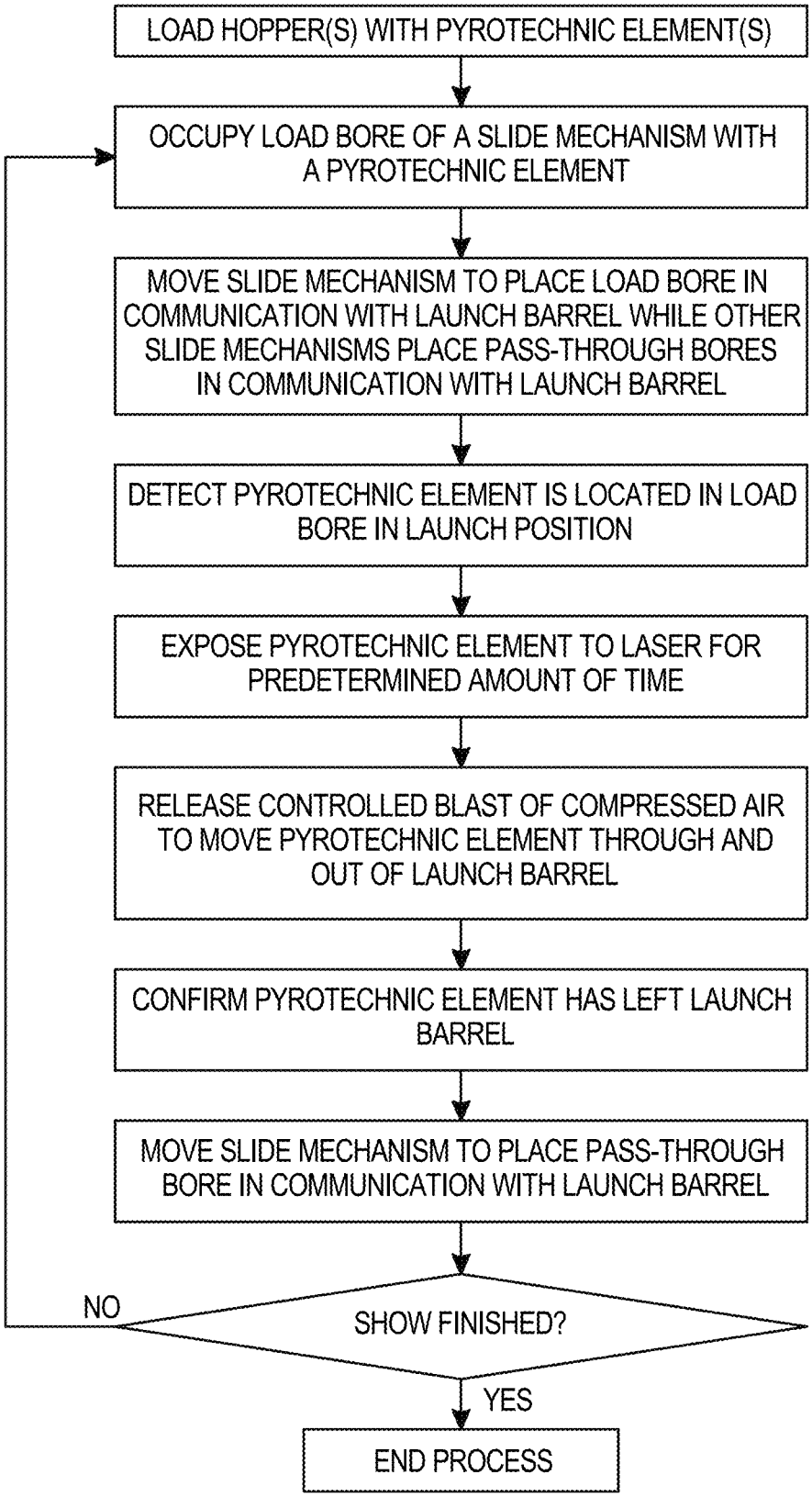
FIG. 28 illustrates a flow chart schematically representing a method of operating the pyrotechnic launch unit of FIG. 1.

Features, objects, and advantages of embodiments may be best understood by reference to the following description, taken in connection with the drawings, in which like reference numerals identify like elements in the several figures.

The pyrotechnic elements, which are sometimes referred to as "stars," burn to produce various bright and vivid predetermined colors and/or sparking effects. The pyrotechnic elements burn but do not explode. The pyrotechnic elements have a burn rate that varies depending on the size, density, geometry, composition, and other properties of the pyrotechnic element. The burn rate of pyrotechnic elements is typically available from their manufacturers.

In some embodiments, the pyrotechnic elements are spherical in shape. In other embodiments, the pyrotechnic elements are cylindrical in shape. Whatever shape of pyrotechnic element is used, it is beneficial if the elements are substantially uniform in density and outer surface to ensure reproducible launch trajectories.

The pyrotechnic elements are made of, for example, metal powders, salts, and other compounds which, when ignited, burn with the desired color or colors and/or with a sparking effect. Pyrotechnic elements made with nitrocellulose compositions are particularly preferred since they do not produce significant amounts of smoke after launch.

Referring now to the Figures, an elbow module (or launch module) 110 includes a first block 112, a second block 114, a barrel (or launch barrel) 116, and optionally a member 118. First block 112 has an interior surface 112*a* and an exterior surface 112*b*. A first hollowed portion 112*c* extends from a top edge 112*d* to a first side edge 112*e* of the first block 112. Optionally, a second hollowed portion 112*f* extends from the first hollowed portion 112*c* to a second side edge 112*g* located opposite first side edge 112*e*. Second block 114 has an interior surface 114*a* and an exterior surface 114*b*. A first hollowed portion 114*c* extends from a top edge 114*d* to a first side edge 114*e* of the second block 114. The first hollowed portion 114*c* of second block 114 is the mirror image of the first hollowed portion 112*c* of first block 112. Optionally, a second hollowed portion 114*f* extends from the first hollowed portion 114*c* to a second side edge 114*g* located opposite first side edge 114*e*. The second hollowed portion 114*f* of second block 114 is the mirror image of the first hollowed portion 112*f* of first block 112.

First block 112 is fastened to second block 114 such that interior surface 112*a* abuts interior surface 114*a* and first hollowed portion 112*c* and first hollowed portion 114*c* form a chamber (or elbow passage) 110*a* that extends from a top surface 110*b* to a first side surface 110*c*. Chamber 110*a* has a cross-section 110*d*, an opening 110*e* at top surface 110*b*, and an opening 110*f* at first side surface 110*c*. Preferably, openings 110*e* and 110*f* are circular openings. Chamber 110*a* is formed in the shape of an elbow having an angle θ between 90° and 135°. Preferably angle θ is 90°.

If second hollowed portions 112*f* and 114*f* are present, together they form a cavity 110*g* that extends from chamber 110*a* to a second side surface 110*h* opposite first side surface 110*c*. Cavity 110*g* provides access to chamber 110*a* to facilitate cleaning chamber 110*a* or removing any obstructions from chamber 110*a*. Cavity 110*g* has an opening 110*i* on a second surface 110*h*.

Member 118 is removably secured in cavity 110*g* and it is sized and shaped to complete the elbow shape of chamber 110*a*.

Barrel 116 is a cylindrical tube having a first opening 116*a* at one end and a second opening 116*b* at the opposite end. Barrel 116 is attached to opening 110*e* on top surface 110*b*. Preferably, barrel 116 is attached into a counterbore 110*j* located around opening 110*e*.

In some embodiments, a single block may replace first and second blocks 112, 114. The blocks in any of the embodiments can be machined to form chambers and cavities using methods such as drilling, CNC machining, electrochemical machining, electrochemical discharge machining, electric discharge machining, or other methods known to a skilled artisan.

A front module (or first module) 130 is coupled in series to the launch module 110. The first module 130 includes a first front block 132, a second front block 134, a first slide retainer block 136, a slide mechanism (or first slide member) 138, a first hopper tube 140, and a first laser ignition module 142. First front block 132 has an interior surface 132*a* and an exterior surface 132*b*. A first hollowed portion 132*c* extends from a top edge 132*d* to a first side edge 132*e* of the first front block 132. Second front block 134 has an interior surface 134*a* and an exterior surface 134*b*. A first hollowed portion 134*c* extends from a top edge 134*d* to a first side edge 134*e* of the second front block 134. The first hollowed portion 134*c* of second block 134 is the mirror image of the first hollowed portion 132*c* of first front block 132. First front block 132 has first side surface 132*f* and a second side surface 132*g* opposite first side surface 132*f*. First side surface 132*f* has a first opening 132*h* and second side surface 132*g* has a second opening 132*i*. A pass-through chamber (or output passage) 132*j* extends from first opening 132*h* to second opening 132*i*. Preferably, first opening 132*h* and second opening 132*i* are circular and pass-through chamber 132*j* is preferably cylindrical.

First front block 132 is fastened to second front block 134 such that interior surface 132*a* abuts interior surface 134*a* and first hollowed portion 132*c* and first hollowed portion 134*c* form a chamber (or first delivery passage) 130*a* that extends from a top surface 130*b* to a first side surface 130*c*. Chamber 130*a* has a cross-section 130*d*, an opening 130*e* at top surface 130*b*, and an opening 130*f* at first side surface 130*c*. Preferably, openings 130*e* and 130*f* are circular openings. Chamber 130*a* is formed in the shape of an elbow having an angle α between 90° and 135°. Preferably angle α is 90°.

Hopper tube 140 is a tube having a first opening 140*a* at one end and a second opening 140*b* at the opposite end. Hopper tube 140 is attached to opening 130*e* on top surface 130*b*. Preferably, hopper tube 140 is attached into a counterbore 130*j* located around opening 130*e*. Preferably, hopper tube 140 is cylindrical.

First slide retainer block 136 has a top surface 136*a*, an elongated cavity 136*b*, an inner surface 136*c*, and a side surface 136*d*. Inner surface 136*c* is opposite top surface 136*a*. A bore 136*e* extends from top surface 136*a* to inner surface 136*c* forming an opening 136*f* on top surface 136*a* and an opening 136*g* in inner surface 136*c*.

Slide mechanism 138 has front surface 138*a*, rear surface 138*b* opposite front surface 138*a*, and a top surface 138*c*. Slide mechanism 138 is slidably mounted in elongated cavity 136*b*. Preferably, front surface 138*a* and rear surface 138*b* are flat. Slide mechanism 138 includes a first pass-through bore 138*d* and a first load bore 138*e* each extending from front surface 138*a* to rear surface 138*b*. A bore 138*f* extends from top surface 138*c* to load bore 138*e* forming an opening (or first laser opening) 138*g* on top surface 138*c*.

First slide retainer block 136 is fastened to first front block 132 and second front block 134. Preferably, first slide retainer block 136 is fastened with screws.

Slide mechanism 138 is driven by a first piston 40 that is attached to slide mechanism 138 by a first piston rod 42. Piston 40 may be pneumatic or hydraulic; preferably, it is a pneumatic piston. Piston 40 moves slide mechanism 138 between a load position and a launch position.

In the load position (or first load state), load bore 138*e* is positioned to align with opening 130*f* of chamber 130*a* to receive successive pyrotechnic elements from hopper tube 140 and chamber 130*a* and pass-through bore 138*d* is positioned to align with pass-through chamber 132*j*. In this sense, the first load state coincides with a first pass-through state.

In the launch position (or first ignition state), load bore 138*e* is positioned to align with pass-through chamber 132*j* and bore 138*f* of slide mechanism 138 is positioned to align with bore 136*e* of first slide retainer block 136. When bore 138*f* is aligned with bore 136*e*, they form a laser beam channel.

Laser ignition module 142 is disposed on top surface 136*a* of first slide retainer block 136. Laser ignition module 142 includes a laser diode and a lens. Laser diode produces a laser beam to ignite the pyrotechnic element before launch. Laser beam passes through laser beam channel. Laser beam channel is intended to minimize "blowback" from the pyrotechnic element and therefore is dimensioned to allow laser beam to pass through the channel while minimizing loss of air pressure during launch. Preferably, laser beam channel has a diameter that is at least 2 millimeters and more preferably 5 millimeters. The laser ignition module 142 is programmed to project a laser for a predetermined amount of time, such as 10 milliseconds to 50 milliseconds.

In a preferred embodiment, a coupling tube 148 has an end 148*a* and an end 148*b* opposite end 148*a*. End 148*a* is attached into a counterbore 110*k* located around opening 110*f* and end 148*b* is attached into a counterbore 132*k* located around opening 132*i*.

A rear module (or second module) 150 is coupled in series to the first module 130. The rear module 150 includes a first rear block 152, a second rear block 154, a second slide retainer block 156, a slide mechanism (or second slide member) 158, a second hopper tube 160, and a second laser ignition module 162. First rear block 152 has an interior surface 152*a* and an exterior surface 152*b*. A first hollowed portion 152*c* extends from a top edge 152*d* to a first side edge 152*e* of the first rear block 152. Second rear block 154 has an interior surface 154*a* and an exterior surface 154*b*. A first hollowed portion 154*c* extends from a top edge 154*d* to a first side edge 154*e* of the second rear block 154. The first hollowed portion 154*c* of second rear block 154 is the mirror image of the first hollowed portion 152*c* of first rear block 152. First rear block 152 has first side surface 152*f* and a second side surface 152*g* opposite first side surface 152*f*. First side surface 152*f* has a first opening 152*h* and second side surface 152*g* has a second opening 152*i*. A pass-through chamber (or air input passage) 152*j* extends from first opening 152*h* to second opening 152*i*. Preferably, first opening 152*h* and second opening 152*i* are circular and pass-through chamber 152*j* is preferably cylindrical. In some embodiments, the pass-through chamber 152*j* receives pressurized air therethrough to launch the pyrotechnic elements.

First rear block 152 is fastened to second rear block 154 such that interior surface 152*a* abuts interior surface 154*a* and first hollowed portion 152*c* and first hollowed portion 154*c* form a chamber (or second delivery passage) 150*a* that extends from a top surface 150*b* to a first side surface 150*c*. Chamber 150*a* has a cross-section 150*d*, an opening 150*e* at top surface 150*b*, and an opening 150*f* at first side surface 150*c*. Preferably, openings 150*e* and 150*f* are circular openings. Chamber 150*a* is formed in the shape of an elbow having an angle R between 90° and 135°. Preferably angle R is 90°.

Hopper tube 160 is a tube having a first opening 160*a* at one end and a second opening 160*b* at the opposite end. Hopper tube 160 is attached to opening 150*e* on top surface 150*b*. Preferably, hopper tube 160 is attached into a counterbore 150*j* located around opening 150*e*. Preferably, hopper tube 160 is cylindrical.

Second slide retainer block 156 has a top surface 156*a*, an elongated cavity 156*b*, an inner surface 156*c*, and a side surface 156*d*. Inner surface 156*c* is opposite top surface 156*a*. A bore 156*e* extends from top surface 156*a* to inner surface 156*c* forming an opening 156*f* on top surface 156*a* and an opening 156*g* in inner surface 156*c*.

Slide mechanism 158 has front surface 158*a*, rear surface 158*b* opposite front surface 158*a*, and a top surface 158*c*. Slide mechanism 158 and is slidably mounted in elongated cavity 156*b*. Preferably, front surface 158*a* and rear surface 158*b* are flat. Slide mechanism 158 includes a pass-through bore 158*d* and a second load bore 158*e* each extending from front surface 158*a* to rear surface 158*b*. A bore 158*f* extends from top surface 158*c* to load bore 158*e* forming an opening (or second laser opening) 158*g* on top surface 158*c*.

Second slide retainer block 156 is fastened to first rear block 152 and second rear block 154. Preferably, second slide retainer block 156 is fastened with screws.

Slide mechanism 158 is coupled to a driving mechanism. In one embodiment, the driving mechanism comprises a second piston 44 that is attached to slide mechanism 158 by a second piston rod 46. Piston 44 may be pneumatic or hydraulic; preferably, it is a pneumatic piston. Piston 44 moves slide mechanism 158 between the load position and the launch position.

In another embodiment, the driving mechanism comprises a motor that is coupled to slide mechanism 158. The motor can be a linear motor, a servo motor, a stepper motor, or any motor that can drive slide mechanism 158 in a linear motion.

In the load position (or second load state), load bore 158*e* is positioned to align with opening 150*f* of chamber 150*a* to receive successive pyrotechnic elements from hopper tube 160 and chamber 150*a* and pass-through bore 158*d* is positioned to align with pass-through chamber 152*j*. In this sense, the second load state coincides with a second pass-through state. In some embodiments, only pressurized air travels through the pass-through bore 158*d*. In other embodiments, however, pyrotechnic elements from upstream modules also travel through pass-through bore 158*d*.

In the launch position (or second ignition state), load bore 158*e* is positioned to align with pass-through chamber 152*j* and bore 158*f* of slide mechanism 158 is positioned to align with bore 156*e* of second slide retainer block 156. When bore 158*f* is aligned with bore 156*e*, they form a laser beam channel 22.

Laser ignition module 162 is disposed on top surface 156*a* of second slide retainer block 156. Laser ignition module 162 includes a laser diode 162*a* and a lens 162*b*. Laser diode 162*a* produces a laser beam 62 to ignite the pyrotechnic element before launch. Laser beam 62 passes through laser beam channel 22. Laser beam channel 22 is intended to minimize "blowback" from the pyrotechnic element and therefore is dimensioned to allow laser beam 62 to pass through the channel while minimizing loss of air pressure during launch. Preferably, laser beam channel 22 has a diameter that is at least 2 millimeters and more preferably 5 millimeters. The laser ignition module 162 is programmed to project a laser for a predetermined amount of time, such as 10 milliseconds to 50 milliseconds.

Some embodiments have one or more hopper tubes that feed the pyrotechnic elements. Pyrotechnic launch assemblies including one, two, three, eight, or the like number of hopper tubes are contemplated herein.

The elbow module, such as elbow module 110, can be fixed or pivotably attached to the front module 130. When pivotably attached, the elbow module 110 pivots between −90° and 90°, for instance. The elbow module 110 can be pivoted to a specified angle between each launch of a pyrotechnic element.

An air supply system may be attached to the pyrotechnic launch assembly to provide compressed air to actuate the pistons 40, 44. The air supply system may include an air compressor, air tank, power source, air delivery lines, air pressure regulator, or the like to provide a desired output pressure of air to actuate the pistons 40, 44.

In some embodiments, a retainer plate 30 disposed between the first module 130 and the second module 150. In the illustrated embodiment, the retainer plate 30 is coupled to each of the first slide retainer block 136 and the second slide retainer block 156. The retainer plate 30 includes a bore 32 defined therein. The bore 32 allows pyrotechnic elements and/or pressurized air to pass therethrough.

In accordance with embodiments disclosed herein, multiple pyrotechnic elements (or spherical capsules containing multiple pyrotechnic elements) are loaded into each hopper tube of the pyrotechnic launch assembly. In some embodiments, each hopper may be loaded with pyrotechnic elements of a particular color or other display feature. Other embodiments allow for a mix of colors for the pyrotechnic elements of each hopper. Each slide mechanism of the pyrotechnic launch assembly is in the load position. A first pyrotechnic element may be received in the load bore of the slide mechanism. Pyrotechnic elements are launched in succession by operating the slide mechanisms one at a time in a predetermined or random launch cycle. The launch cycle starts when the slide mechanism is moved by its associated piston to transport pyrotechnic element into the launch position. In the launch position, a pyrotechnic element is located in the launch channel. While the pyrotechnic element is in the launch channel for one particular slide mechanism, all other slide mechanisms are placed in the pass-through position. The laser ignition module is activated to emit a laser beam that ignites the pyrotechnic element.

The air supply system supplies a regulated blast of air to propel the ignited pyrotechnic element through the launch channel (and the pass-through channels of the other downstream slide mechanisms, if any are present), into the elbow module, and into the air to the desired elevation and trajectory. The launch cycle ends when the slide mechanism is moved by its associated piston to the load position to receive the next pyrotechnic element, which places the pass-through channel of the slide mechanism in the launch channel so another module may fire and launch its respective pyrotechnic element. Some embodiments further include one or more sensors confirming whether the previous pyrotechnic element has left the launch channel prior to firing another pyrotechnic element with a laser. In some embodiments, each launch cycle may be completed within 100 milliseconds.

For example, a pyrotechnic launch assembly may have multiple hopper tubes with each supplying pyrotechnic elements of different colors that are launched in a predetermined order starting from the front module and continuing with one or more additional modules from closest to farthest relative to the elbow module. The first launch cycle launches the pyrotechnic element in the front module. The second launch cycle launches the pyrotechnic element in the module closest to the front module. Depending on the number of modules, additional launch cycles will proceed after the second launch cycle, if additional modules are present. Launch cycles may be repeated until the hopper tubes are empty.

The above process can be controlled by onboard circuitry which may receive commands from a conventional DMX-based lighting console to achieve a rapid repeatable multiple pyrotechnic element launch process. In some embodiments, the programming and timing need not be adjusted by the user. However, variables including air pressure and height may still be user-controlled.

In addition, sensors such as optical sensors and limit switches may be included in the pyrotechnic launch assembly to monitor for obstructions, such as jammed pyrotechnic elements or slide mechanisms, or to monitor the launch cycles. Other embodiments include one or more sensors detecting whether a pyrotechnic element has been loaded for firing.

The force (e.g., pressure) of the regulated blast of air may depend in part on the burn rate of the pyrotechnic element and the desired height to which the pyrotechnic element will be propelled. The higher the burn rate, the greater the force of the regulated blast of air to propel a pyrotechnic element to the same height as a pyrotechnic element with a lower burn rate.

In some embodiments, the regulated blast of air is set to a fixed pressure within an appropriate range. In another embodiment, the regulated blast of air may be varied between launches to different pressures within the appropriate range. By varying the pressure, a pyrotechnic launch assembly with two or more hoppers may launch pyrotechnic elements having the same burn rate to different heights or pyrotechnic elements having different burn rates to the same height. For example, a pyrotechnic launch assembly with two hoppers, each loaded with the same type of pyrotechnic element, can be operated with a variable regulated blast of air to launch the elements to different heights. In another example, a pyrotechnic launch assembly with two hoppers—one hopper loaded with a pyrotechnic element having a faster burn rate than the other hopper—may be operated with variable regulated blast of air to launch the elements to the same height. The elements with the faster burn rate would require a regulated blast of air at a relatively higher pressure, whereas the elements with the slower burn rate would require a regulated blast of air at a relatively lower pressure.

Although only first and second modules 130, 150 have been described and illustrated herein, further modules are also contemplated. In some embodiments, the pyrotechnic launch assembly is a modular pyrotechnic launch assembly that can be expanded or condensed in number of modules depending on the needs of a particular display to be created. In some embodiments, a third module that is identical to the first module 130 can be coupled in series to the second module 150. A fourth module that is identical to the second module 150 can be coupled in series to the third module. In the illustrated embodiment, the first module 130 and second module 150 face each other with the retainer plate 30 disposed therebetween. The third and fourth module may similarly face each other, and the third module may be removably coupled to the second module.

The use of the terms "a" and "an" and "the" and similar references in the context of describing embodiments (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable other unless otherwise indicated herein or otherwise clearly contradicted by context. The use of any and all examples, or exemplary language (i.e., "such as") provided herein, is intended merely to illuminate embodiments and does not pose a limitation on the scope of the embodiments unless otherwise claimed. No language in the specification should be construed as indicating any non-claimed element as essential to the practice of the embodiments.

Variations of the described embodiments may become apparent to those of ordinary skill in the art upon reading the foregoing description. The inventors expect skilled artisans to employ such variations as appropriate, and the inventors intend for the embodiments to be practiced otherwise than as specifically described herein. Accordingly, embodiments include all modifications and equivalents of the subject matter recited in the claims appended hereto as permitted by applicable law. Moreover, any combination of the above-described elements in all possible variations thereof is encompassed embodiments unless otherwise indicated herein or otherwise clearly contradicted by context.

What is claimed is:

1. A pyrotechnic element projectile launch unit comprising:

a first module including;

a first chamber extending from a first inlet opening to a first outlet opening, and a first load bore and a first pass-through bore selectively positioned in communication with the first chamber, the first load bore configured to load a first pyrotechnic element projectile in the first chamber;

a second module including;

a second chamber having a second outlet in communication with the first inlet opening, and a second load bore selectively positioned in communication with the second chamber, the second load bore configured to load a second pyrotechnic element projectile in the second chamber; and an ignition module configured to ignite at least one of the first pyrotechnic element projectile and the second pyrotechnic element projectile;

wherein with the first pass-through bore positioned in communication with the first chamber, the second pyrotechnic element projectile is permitted to pass through the second outlet, the first inlet opening, and the first pass-through bore to the first outlet opening.

2. The pyrotechnic launch unit of claim 1, wherein the first module includes a first block that at least partially defines the first chamber, and the ignition module is mounted to the first block.

3. The pyrotechnic launch unit of claim 2, wherein the first module includes a first slide member with the first load bore, the first pass-through bore, and a first opening.

4. The pyrotechnic launch unit of claim 3, wherein the first slide member is slidable relative to the first block to selectively locate either the first pass-through bore or the first load bore in communication with the first chamber.

5. The pyrotechnic launch unit of claim 4, wherein with the first slide member positioned with the first load bore in communication with the first chamber, the first opening is in communication with the first chamber via a first ignition channel, and the ignition module is configured to pass ignition media from the ignition module through the first opening and the first ignition channel to the first chamber to ignite the first pyrotechnic element projectile.

6. The pyrotechnic launch unit of claim 5, wherein the ignition module is a laser ignition module, and the laser ignition module is configured to project laser ignition media through the first ignition channel.

7. The pyrotechnic launch unit of claim 4, wherein the first slide member is movable to load the first pyrotechnic element projectile in the first load bore with the first pyrotechnic element projectile separated from at least one additional first pyrotechnic element projectile of the first module.

8. The pyrotechnic launch unit of claim 7, wherein the second pyrotechnic element projectile is capable of being loaded into the second load bore with the second pyrotechnic element projectile separated from at least one additional second pyrotechnic element projectile of the second module, the first pyrotechnic element projectile of the first module, and the at least one additional first pyrotechnic element projectile of the first module.

9. The pyrotechnic launch unit of claim 1, wherein the second module is removably coupled to the first module.

10. A pyrotechnic element projectile launch unit comprising:

a front module including;

a front chamber extending from a front inlet opening to a front outlet opening, and a front load bore and a front pass-through bore selectively positioned in communication with the front chamber, the front load bore configured to load a front pyrotechnic element projectile in the front chamber; and a rear module including;

a rear chamber having a rear outlet opening in communication with the front inlet opening, and a rear load bore selectively positioned in communication with the rear chamber, the rear load bore configured to load a rear pyrotechnic element projectile in the rear chamber;

wherein the front module and the rear module are coupled in series with the rear outlet opening in communication with the front inlet opening such that the rear pyrotechnic element projectile can be passed from the rear module through the front pass-through bore to the front outlet opening.

11. The pyrotechnic launch unit of claim 10, further comprising one or more intermediate modules including;

an intermediate chamber extending from an intermediate inlet opening to an intermediate outlet opening; and an intermediate load bore and an intermediate pass-through bore selectively positioned in communication with the intermediate chamber, the intermediate load bore configured to load an intermediate pyrotechnic element projectile in the intermediate chamber;

wherein the one or more intermediate modules is coupled in series between the rear module and the front module.

12. The pyrotechnic launch unit of claim 11, wherein the front pass-through bore and the intermediate pass-through bore are movable to the front chamber and the intermediate chamber simultaneously such that the rear pyrotechnic element projectile is permitted to pass from the rear chamber through the rear outlet opening and each of the intermediate chamber and the front chamber.

13. The pyrotechnic launch unit of claim 11, wherein the front module, intermediate module, and rear module are removably coupled to one another.

14. The pyrotechnic launch unit of claim 10, further comprising an ignition module configured to ignite at least one of the front pyrotechnic element projectile and the rear pyrotechnic element projectile.

15. The pyrotechnic launch unit of claim 10, wherein the rear module further includes a rear input passage in selective communication with the rear chamber, the rear input passage being configured to receive pressurized air to propel at least one of the rear pyrotechnic element projectile or the front pyrotechnic element projectile from the front outlet opening.

16. The pyrotechnic launch unit of claim 10, wherein the front module includes a front slide member with the front load bore and the front pass-through bore, the front slide member being slidable relative to the front chamber; and the rear module includes a rear slide member with the rear load bore, the rear slide member being slidable relative to the rear chamber.

17. The pyrotechnic launch unit of claim 16, further comprising control circuitry capable of operating the pyrotechnic launch unit in a launch cycle including a rear launch condition whereby the front slide member locates the front pass-through bore in the front chamber and the rear slide member loads the rear pyrotechnic element projectile in the rear chamber.

18. The pyrotechnic launch unit of claim 10, wherein the rear module is removably coupled to the front module.

19. The pyrotechnic launch unit of claim 10, wherein the front pyrotechnic element projectile is capable of being loaded in the front chamber with the front pyrotechnic element projectile separated from at least one additional front pyrotechnic element projectile.

* * * * *